US007760225B2

(12) United States Patent
Yoshizawa et al.

(10) Patent No.: US 7,760,225 B2
(45) Date of Patent: Jul. 20, 2010

(54) IMAGE FORMING APPARATUS, OPTICAL WRITING DEVICE, AND HOUSING MOLDING METHOD PROVIDING SIMPLE STRUCTURE

(75) Inventors: Hiroshi Yoshizawa, Kawasaki (JP); Takeshi Yamakawa, Fujisawa (JP); Katsunori Shoji, Chigasaki (JP)

(73) Assignee: Ricoh Company, Limited, Tokyo (JP)

( * ) Notice: Subject to any disclaimer, the term of this patent is extended or adjusted under 35 U.S.C. 154(b) by 3 days.

(21) Appl. No.: 11/643,701

(22) Filed: Dec. 22, 2006

(65) Prior Publication Data

US 2007/0165099 A1 Jul. 19, 2007

(30) Foreign Application Priority Data

Dec. 28, 2005 (JP) ..... 2005-377314

(51) Int. Cl.

| | |
|---|---|
| ***B41J 2/385*** | (2006.01) |
| ***B41J 2/41*** | (2006.01) |
| ***B41J 2/435*** | (2006.01) |
| ***B41J 2/45*** | (2006.01) |
| ***B41J 15/14*** | (2006.01) |
| ***B41J 27/00*** | (2006.01) |

(52) U.S. Cl. ..... 347/242; 347/118; 347/130; 347/137; 347/138; 347/152; 347/232; 347/238; 347/243; 347/245; 347/257; 347/261; 347/263

(58) Field of Classification Search ..... None
See application file for complete search history.

(56) References Cited

U.S. PATENT DOCUMENTS 4,305,650 A 12/1981 Knox
4,800,401 A 1/1989 Sato et al.
4,928,122 A * 5/1990 Doi et al. ..... 347/241

(Continued)

FOREIGN PATENT DOCUMENTS

JP A-04-149578 5/1992

(Continued)

OTHER PUBLICATIONS

European Search Report dated Jan. 30, 2009.

(Continued)

*Primary Examiner*—Matthew Luu
*Assistant Examiner*—Kendrick X Liu
(74) *Attorney, Agent, or Firm*—Harness, Dickey & Pierce, P.L.C.

(57) ABSTRACT

An image forming apparatus includes an electrostatic latent image carrier, and an optical writing device including at least one light source, at least one aperture, at least one light shield, a light deflector, an image forming lens, and a housing. The aperture adjusts a light beam generated by the light source into a reference shape. The light shield shields an optical path formed between the light source and the aperture by the light beam. The light deflector deflects the light beam to scan in a main scanning direction. The image forming lens focuses the deflected light beam to scan on the surface of the electrostatic latent image carrier to form an electrostatic latent image on the surface of the electrostatic latent image carrier. The housing contains the light source, the light deflector, and the image forming lens. The housing is integrally molded with the aperture and the light shield.

17 Claims, 13 Drawing Sheets

U.S. PATENT DOCUMENTS

| | | | | |
|---|---|---|---|---|
| 6,097,749 | A * | 8/2000 | Naoe et al. | 372/103 |
| 6,249,368 | B1 | 6/2001 | Hsu | |
| 2002/0149666 | A1 * | 10/2002 | Amada et al. | 347/233 |
| 2004/0145644 | A1 * | 7/2004 | Makino | 347/233 |
| 2005/0174418 | A1 * | 8/2005 | Sakaue et al. | 347/112 |
| 2005/0206716 | A1 * | 9/2005 | Peters | 347/225 |
| 2005/0213623 | A1 * | 9/2005 | Ozasa et al. | 372/38.02 |

FOREIGN PATENT DOCUMENTS

| | | |
|---|---|---|
| JP | 05-060958 | 3/1993 |
| JP | A-06-067104 | 3/1994 |
| JP | 06-028814 | 4/1994 |
| JP | 07-134259 | 5/1995 |
| JP | 07-270695 | 10/1995 |
| JP | 07270695 A * | 10/1995 |
| JP | 07-318835 | 12/1995 |
| JP | 2002-162593 | 6/2002 |
| JP | A-2003-75938 | 3/2003 |
| JP | A-2003-76093 | 3/2003 |
| JP | 2004-272273 | 9/2004 |
| JP | 2004-295132 | 10/2004 |

OTHER PUBLICATIONS

Communication from Chinese Patent Office, dated Jun. 6, 2008 for counterpart Chinese application No. 2006101714127.

* cited by examiner

IMAGE FORMING APPARATUS, OPTICAL WRITING DEVICE, AND HOUSING MOLDING METHOD PROVIDING SIMPLE STRUCTURE

PRIORITY STATEMENT

This application claims the priority of Japanese Patent Application No. 2005-377314, filed on Dec. 28, 2005, the disclosure of which is hereby incorporated herein, in its entirety, by reference.

BACKGROUND

1. Technical Field

Example embodiments of the present invention generally relate to an image forming apparatus, an optical writing device, and/or a housing molding method providing a simple structure, e.g., for preventing a light leakage.

2. Description of Background Art

A background image forming apparatus, for example, a copying machine, a printer, a facsimile machine, or a multi-function printer having copying, printing, scanning, and facsimile functions, forms a toner image on a recording medium (e.g., a sheet). In the image forming apparatus, an optical writing device scans a light beam onto an electrostatic latent image carrier (e.g., a photoconductor) according to image data to form an electrostatic latent image on the photoconductor. The electrostatic latent image is developed with a developer (e.g., a toner) to form a toner image. The toner image is transferred onto a sheet. Thus, the toner image is formed on the sheet.

One example of a background optical writing device includes a light source, a polygon mirror, a polygon motor, an image forming lens, a light receiver, a sensor, and/or a housing. The light source emits a light beam toward the polygon mirror. The polygon motor drives the polygon mirror. The rotating polygon mirror deflects the light beam toward the image forming lens. The image forming lens focuses the light beam to scan on the surface of the photoconductor to form an electrostatic latent image on the surface of the photoconductor. To form an electrostatic latent image on a valid area on the surface of the photoconductor, a writing start position or a writing end position is adjusted in a main scanning direction. For example, the light receiver receives a light beam irradiating an invalid area outside the valid area on the surface of the photoconductor in the main scanning direction. The sensor outputs a detection signal determining a writing start position in the main scanning direction. The housing contains the light source, the polygon mirror, the polygon motor, and the image forming lens.

The background optical writing device further includes a collimate lens and/or an aperture. The collimate lens collimates a light beam emitted by the light source. The aperture adjusts the collimated light beam into a reference shape.

A light beam entering the collimate lens from an enter plane of the collimate lens may be reflected by an inner wall of an exit plane of the collimate lens, and may be further reflected by an inner wall of the enter plane of the collimate lens before emerging from the exit plane of the collimate lens. The light beam may not irradiate the aperture but may irradiate an opening formed between the collimate lens and the aperture. Thus, the light beam may leak from the opening. Further, a light beam emitted by the light source is diffused before being collected by the collimate lens. The diffused light beam may also leak from an opening formed in the optical writing device.

When the leaked light beam (e.g., a flare light beam) enters the image forming lens, the light beam may reach the surface of the photoconductor via a reflecting lens. As a result, a faulty image having a jitter, a background jitter, and/or an uneven color density may be formed. When the light receiver receives the flare light beam, the sensor may erroneously detect the light beam. As a result, an electrostatic latent image may not be properly formed on the valid area on the surface of the photoconductor.

SUMMARY

At least one embodiment of the present invention may provide an image forming apparatus that includes an electrostatic latent image carrier and an optical writing device. The electrostatic latent image carrier carries an electrostatic latent image. The optical writing device includes at least one light source, at least one aperture, at least one light shield, a light deflector, an image forming lens, and a housing. The light source generates a light beam. The aperture adjusts the light beam generated by the light source into a reference shape. The light shield shields an optical path formed between the light source and the aperture by the light beam generated by the light source. The light deflector deflects the light beam generated by the light source to scan in a main scanning direction. The image forming lens focuses the light beam deflected by the light deflector to scan on the surface of the electrostatic latent image carrier to form an electrostatic latent image on the surface of the electrostatic latent image carrier. The housing contains the light source, the light deflector, and the image forming lens. The housing is integrally molded with the aperture and the light shield.

At least one embodiment of the present invention may provide an optical writing device for forming an electrostatic latent image on an electrostatic latent image carrier. The optical writing device includes at least one light source, at least one aperture, at least one light shield, a light deflector, an image forming lens, and a housing. The light source generates a light beam. The aperture adjusts the light beam generated by the light source into a reference shape. The light shield shields an optical path formed between the light source and the aperture by the light beam generated by the light source. The light deflector deflects the light beam generated by the light source to scan in a main scanning direction. The image forming lens focuses the light beam deflected by the light deflector to scan on the surface of the electrostatic latent image carrier to form an electrostatic latent image on the surface of the electrostatic latent image carrier. The housing contains the light source, the light deflector, and the image forming lens. The housing is integrally molded with the aperture and the light shield.

At least one embodiment of the present invention may provide a housing molding method for molding a housing integrally molded with an aperture and a light shield. The housing molding method includes preparing two housing molds for molding the housing and including an aperture mold for molding the aperture, and preparing an insert including an aperture opening forming protrusion at a foremost head of the insert. The housing molding method further includes clamping the two housing molds to form an insertion space, and inserting the insert into the insertion space in a direction substantially perpendicular to a direction in which the housing molds are opened, until the aperture opening forming protrusion of the insert touches the aperture mold, so as to form a cavity between the housing molds and the insert. The housing molding method further includes filling the cavity with a melted resin, removing the insert when the melted resin is solidified, and opening the housing molds.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
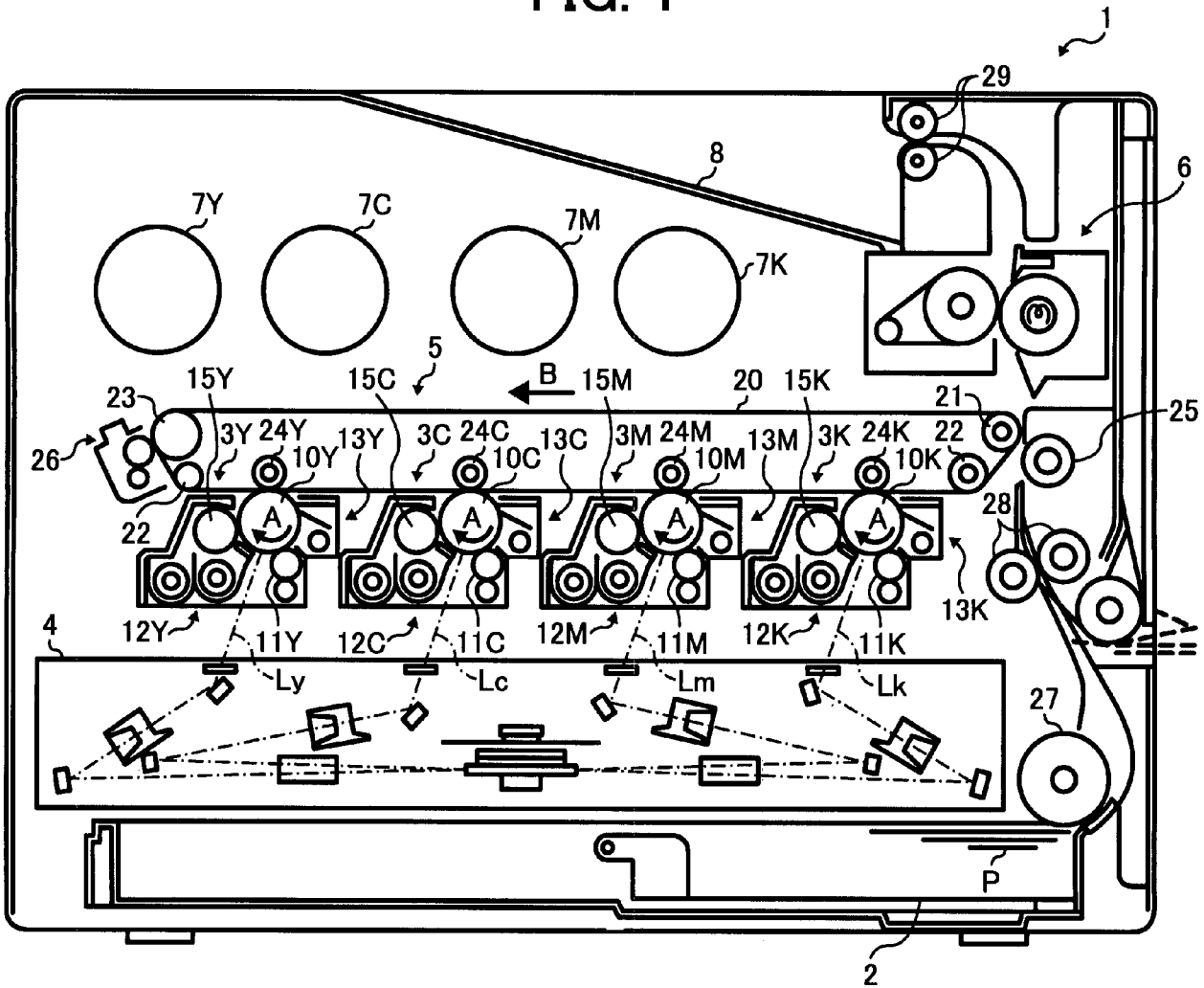
FIG. 1 is a schematic view of an image forming apparatus according to an example embodiment of the present invention.

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment of the present invention is explained.

As illustrated in FIG. 1, the image forming apparatus 1 includes an optical writing unit 4, toner bottles 7Y, 7C, 7M, and 7K, image forming stations 3Y, 3C, 3M, and 3K, a paper tray 2, a feeding roller 27, a registration roller pair 28, an intermediate transfer unit 5, a fixing unit 6, an output roller pair 29, and/or an output tray 8. The image forming stations 3Y, 3C, 3M, and 3K include photoconductors 10Y, 10C, 10M, and 10K, chargers 11Y, 11C, 11M, and 11K, development units 12Y, 12C, 12M, and 12K, and/or cleaners 13Y, 13C, 13M, and 13K, respectively. The development units 12Y, 12C, 12M, and 12K include development rollers 15Y, 15C, 15M, and 15K, respectively. The intermediate transfer unit 5 includes an intermediate transfer belt 20, a driving roller 21, tension rollers 22, a driven roller 23, first transfer rollers 24Y, 24C, 24M, and 24K, a second transfer roller 25, and/or a belt cleaner 26.

The image forming apparatus 1 may be a copying machine, a printer, a facsimile machine, a multifunction printer having copying, printing, scanning, and facsimile functions, or the like, which forms an image on a recording medium (e.g., a sheet). Types of recording medium other than, or in addition to, paper can be used. According to example embodiments, the image forming apparatus 1 functions as a color printer for forming a color image on a sheet by an electrophotographic method. The image forming apparatus 1 is a tandem type printer having four photoconductive drums and using an intermediate transfer method. However, the type and method of the image forming apparatus 1 is not limited to the above.

The optical writing unit 4, serving as an optical writing device, emits light beams Ly, Lc, Lm, and Lk to the image forming stations 3Y, 3C, 3M, and 3K, respectively. The toner bottles 7Y, 7C, 7M, and 7K are disposed in an upper portion of the image forming apparatus 1 and contain yellow, cyan, magenta, and black toners to be supplied to the image forming stations 3Y, 3C, 3M, and 3K, respectively. The toner bottles 7Y, 7C, 7M, and 7K are attachable to and detachable from the image forming apparatus 1. A user can open the output tray 8 to replace the toner bottles 7Y, 7C, 7M, and 7K with new ones. The image forming stations 3Y, 3C, 3M, and 3K are disposed above the optical writing unit 4 in a center portion of the image forming apparatus 1. The image forming stations 3Y, 3C, 3M, and 3K form electrostatic latent images according to the light beams Ly, Lc, Lm, and Lk emitted by the optical writing unit 4, and develop the electrostatic latent images with the toners supplied from the toner bottles 7Y, 7C, 7M, and 7K to form yellow, cyan, magenta, and black toner images, respectively. The paper tray 2 loads sheets P (e.g., a recording medium). The paper tray 2 is disposed in a lower portion of the image forming apparatus 1 and is attachable to and detachable from the image forming apparatus 1.

The feeding roller 27 is disposed near the paper tray 2 and feeds a sheet P from the paper tray 2 toward the registration roller pair 28. The registration roller pair 28 feeds the sheet P toward the intermediate transfer unit 5. The intermediate transfer unit 5 is disposed above the image forming stations 3Y, 3C, 3M, and 3K and carries the yellow, cyan, magenta, and black toner images transferred from the image forming stations 3Y, 3C, 3M, and 3K, respectively. The intermediate transfer unit 5 transfers the yellow, cyan, magenta, and black toner images onto the sheet P to form a color toner image on the sheet P, and feeds the sheet P bearing the color toner image toward the fixing unit 6. The fixing unit 6 fixes the color toner image on the sheet P, and feeds the sheet P bearing the fixed color toner image toward the output roller pair 29. The output roller pair 29 feeds the sheet P bearing the fixed color toner image onto the output tray 8. The output tray 8 is disposed above the toner bottles 7Y, 7C, 7M, and 7K and receives the sheet P bearing the fixed color toner image.

In the optical writing unit 4, laser diodes (not shown) serving as light sources emit light beams Ly, Lc, Lm, and Lk toward a polygon mirror (not shown). The polygon mirror deflects the light beams Ly, Lc, Lm, and Lk toward the photoconductors 10Y, 10C, 10M, and 10K of the image forming stations 3Y, 3C, 3M, and 3K to form electrostatic latent images on the photoconductors 10Y, 10C, 10M, and 10K, respectively.

The photoconductors 10Y, 10C, 10M, and 10K have a drum shape and serve as electrostatic latent image carriers. The photoconductors 10Y, 10C, 10M, and 10K rotate in a rotating direction A. Each of the photoconductors 10Y, 10C, 10M, and 10K includes a cylindrical base and a photosensitive layer. The cylindrical base includes aluminum and has a diameter of about 40 mm. The photosensitive layer includes an OPC (organic photo conductor), for example, and covers the surface of the cylindrical base. The chargers 11Y, 11C, 1M, and 11K, the development units 12Y, 12C, 12M, and 12K, and the cleaners 13Y, 13C, 13M, and 13K are disposed around the photoconductors 10Y, 10C, 10M, and 10K, respectively. The chargers 11Y, 11C, 11M, and 11K uniformly charge the surfaces of the photoconductors 1Y, 10C, 10M, and 10K, respectively, before the optical writing unit 4 emits light beams Ly, Lc, Lm, and Lk onto the photoconductors 10Y, 10C, 10M, and 10K, respectively.

The development units 12Y, 12C, 12M, and 12K develop the electrostatic latent images formed on the photoconductors laY, 10C, 10M, and 10K with yellow, cyan, magenta, and black toners carried by the development rollers 15Y, 15C, 15M, and 15K to form yellow, cyan, magenta, and black toner images, respectively. The cleaners 13Y, 13C, 13M, and 13K remove residual toners remaining on the surfaces of the photoconductors 10Y, 10C, 10M, and 10K after the yellow, cyan, magenta, and black toner images are transferred from the photoconductors 10Y, 10C, 10M, and 10K onto the intermediate transfer belt 20, respectively.

The intermediate transfer belt 20 is looped over the driving roller 21, the tension rollers 22, and the driven roller 23. The intermediate transfer belt 20 rotates in a rotating direction B. The first transfer rollers 24Y, 24C, 24M, and 24K transfer and superimpose the yellow, cyan, magenta, and black toner images formed on the photoconductors 10Y, 10C, 10M, and 10K, respectively, onto the intermediate transfer belt 20. The second transfer roller 25 transfers the yellow, cyan, magenta, and black toner images superimposed on the intermediate transfer belt 20 onto the sheet P fed by the registration roller 28. The belt cleaner 26 contacts the intermediate transfer belt 20 and removes residual toners remaining on the intermediate transfer belt 20 after the yellow, cyan, magenta, and black toner images superimposed on the intermediate transfer belt 20 are transferred onto the sheet P.

Figure 2:
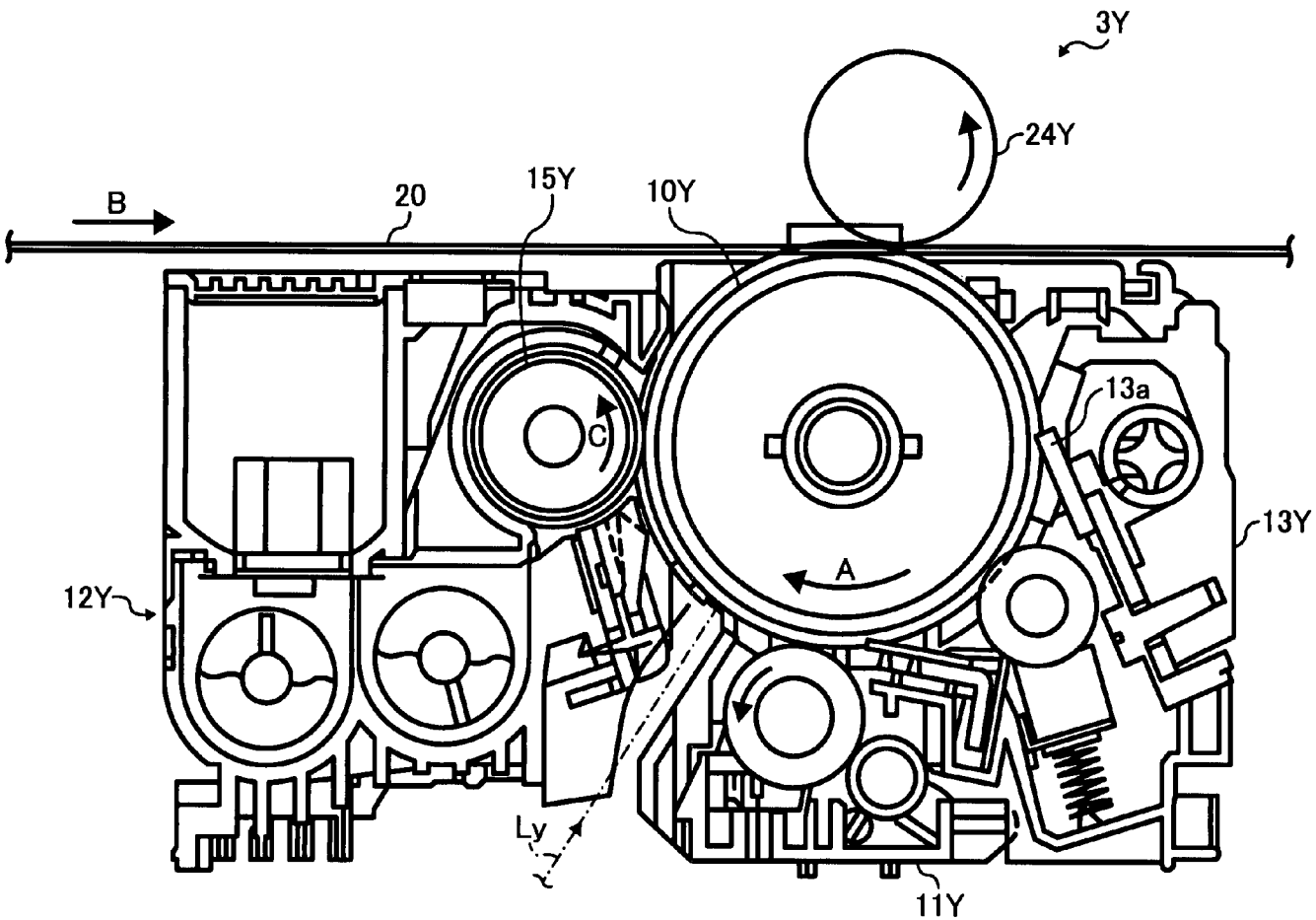
FIG. 2 is a schematic view (according to an example embodiment of the present invention) of an image forming station of the image forming apparatus shown in FIG. 1.

Referring to FIGS. 1 and 2, the following describes operations of the image forming apparatus 1 for forming a color toner image on a sheet P. FIG. 2 illustrates the image forming station 3Y. As illustrated in FIG. 2, the cleaner 13Y includes a cleaning blade 13*a*. Each of the cleaners 13C, 13M, and 13K (depicted in FIG. 1) includes a cleaning blade (not shown) having the structure common to the cleaning blade 13*a*.

As illustrated in FIG. 1, the chargers 11Y, 11C, 11M, and 11K uniformly charge the surfaces of the photoconductors 10Y, 10C, 10M, and 10K, respectively. The optical writing unit 4 emits light beams Ly, Lc, Lm, and Lk according to image data onto the charged surfaces of the photoconductors 10Y, 10C, 10M, and 10K to form electrostatic latent images on the photoconductors 10Y, 10C, 10M, and 10K, respectively. The development units 12Y, 12C, 12M, and 12K develop the electrostatic latent images formed on the photoconductors 10Y, 10C, 10M, and 10K with yellow, cyan, magenta, and black toners carried by the development rollers 15Y, 15C, 15M, and 15K rotating in a rotating direction C (depicted in FIG. 2), to form yellow, cyan, magenta, and black toner images, respectively.

The first transfer rollers 24Y, 24C, 24M, and 24K transfer and superimpose the yellow, cyan, magenta, and black toner images formed on the photoconductors 10Y, 10C, 10M, and 10K, respectively, onto the intermediate transfer belt 20 rotating in the rotating direction B. For example, the yellow, cyan, magenta, and black toner images are sequentially transferred at different times in this order, so that the yellow, cyan, magenta, and black toner images are superimposed on a common position on the intermediate transfer belt 20.

The cleaning blade 13*a* (depicted in FIG. 2) of the cleaner 13Y and the cleaning blades (not shown) of the cleaners 13C, 13M, and 13K clean the surfaces of the photoconductors 10Y, 10C, 10M, and 10K, respectively, so that the photoconductors 10Y, 10C, 10M, and 10K become ready for forming the next electrostatic latent images. Toners are supplied from the toner bottles 7Y, 7C, 7M, and 7K to the development units 12Y, 12C, 12M, and 12K via conveyance routes (not shown), respectively, as needed.

The feeding roller 27 feeds a sheet P from the paper tray 2 toward the registration roller pair 28. The registration roller pair 28 feeds the sheet P to the second transfer roller 25 at a reference time. The second transfer roller 25 transfers the toner images superimposed on the intermediate transfer belt 20 onto the sheet P to form a color toner image on the sheet P. The sheet P bearing the color toner image is fed by the second transfer roller 25 and the intermediate transfer belt 20 toward the fixing unit 6.

The fixing unit 6 fixes the color toner image on the sheet P, and feeds the sheet P bearing the fixed color toner image toward the output roller pair 29. The output roller pair 29 feeds the sheet P bearing the fixed color toner image onto the output tray 8. The belt cleaner 26 removes residual toners remaining on the intermediate transfer belt 20 after the toner images superimposed on the intermediate transfer belt 20 are transferred onto the sheet P.

Figure 3:
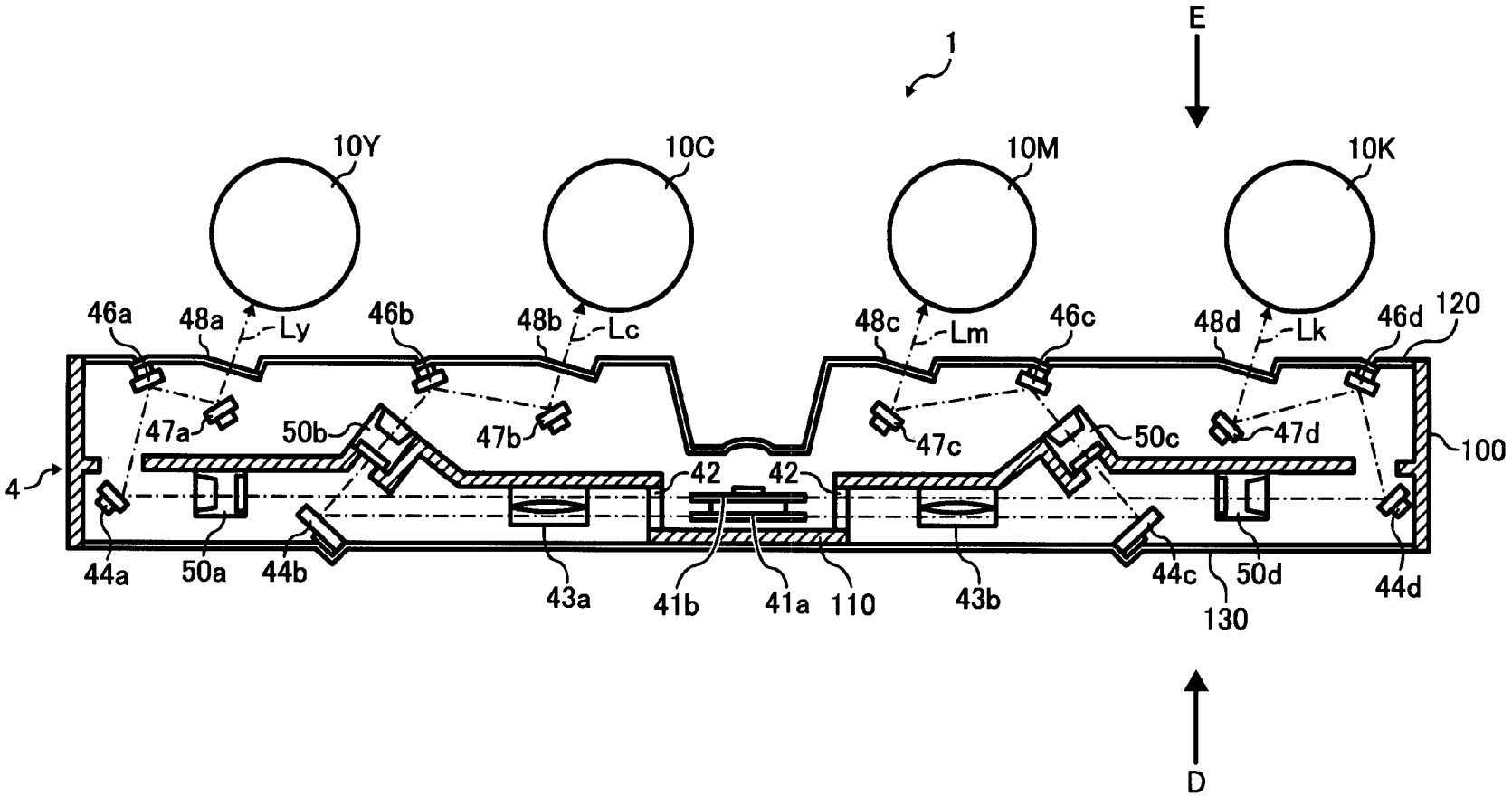
FIG. 3 is a sectional front view (according to an example embodiment of the present invention) of an optical writing unit of the image forming apparatus shown in FIG. 1.
Figure 4:
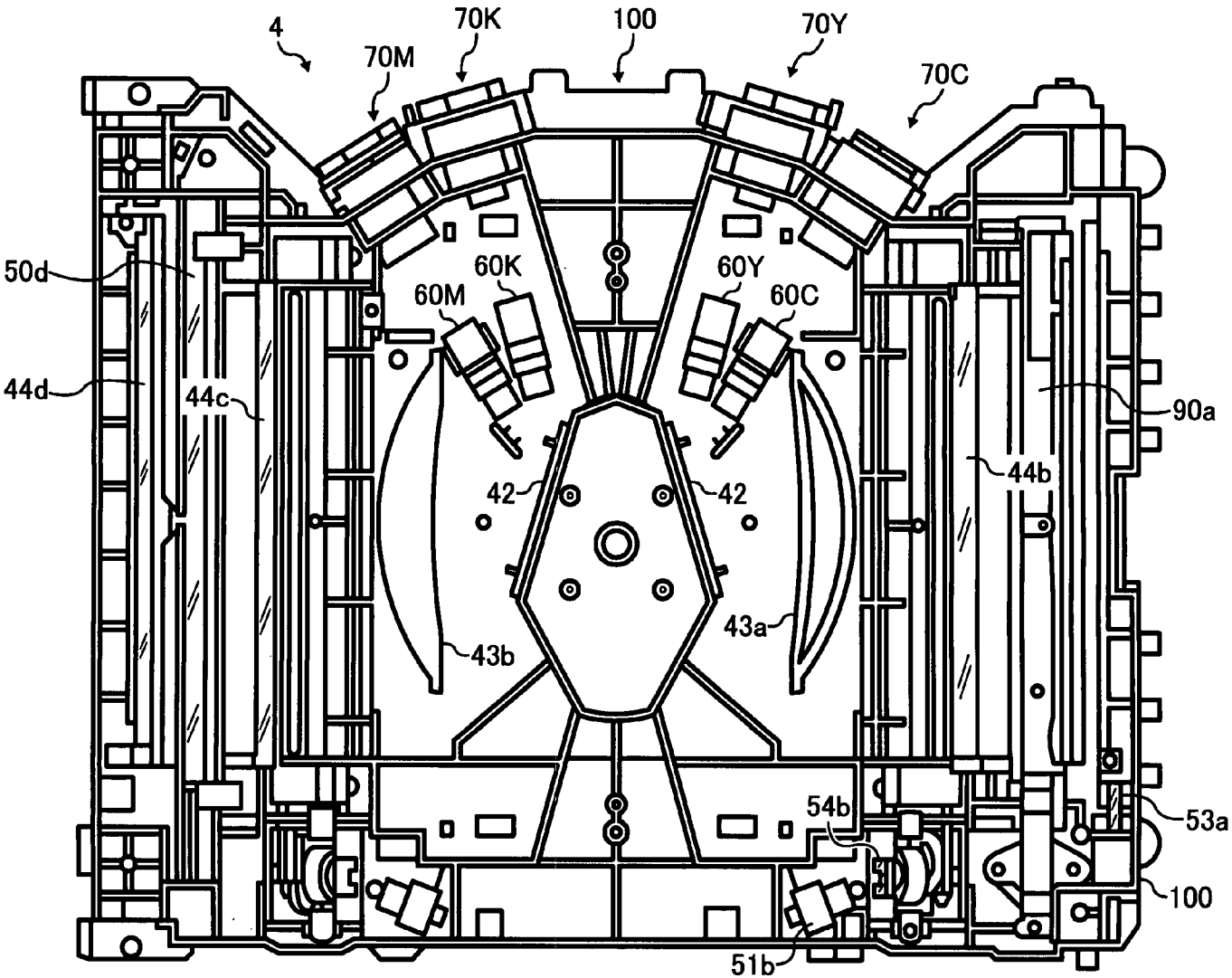
FIG. 4 is a sectional bottom view (according to an example embodiment of the present invention) of an optical writing unit of the image forming apparatus shown in FIG. 1.
Figure 5:
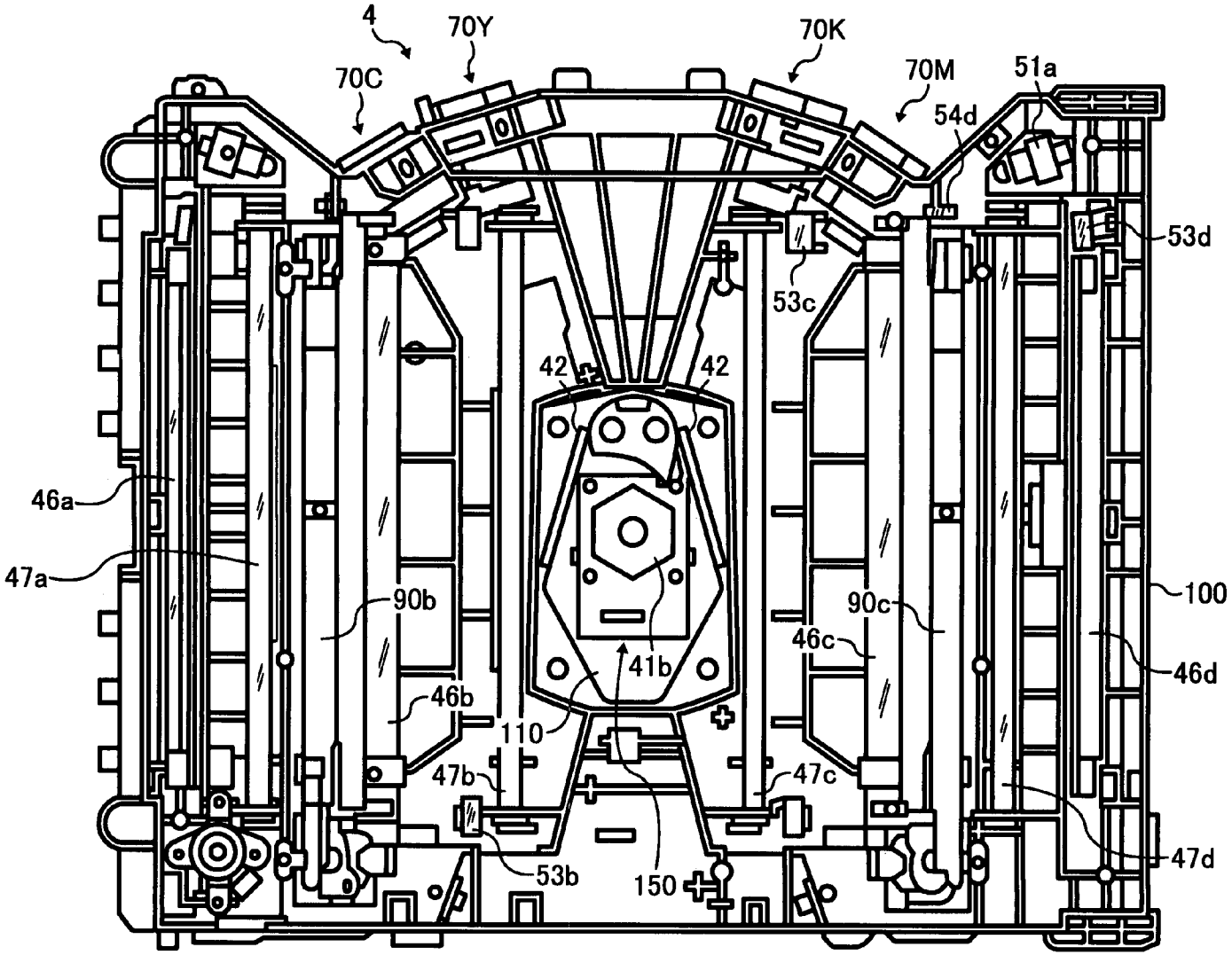
FIG. 5 is a sectional top view (according to an example embodiment of the present invention) of an optical writing unit of the image forming apparatus shown in FIG. 1.

FIGS. 3 to 5 illustrate the optical writing unit 4. FIG. 3 is a front view of the optical writing unit 4 taken in the longitudinal direction of shafts of the photoconductors 10Y, 10C, 10M, and 10K. FIG. 4 is a bottom view of the optical writing unit 4 taken in the direction of an arrow D (depicted in FIG. 3). FIG. 5 is a top view of the optical writing unit 4 taken in the direction of an arrow E (depicted in FIG. 3).

As illustrated in FIGS. 3 to 5, the optical writing unit 4 includes a housing 100 (depicted in FIGS. 3 to 5), light source units 70M, 70K, 70Y, and 70C (depicted in FIGS. 4 and 5), cylindrical lenses 60M, 60K, 60Y, and 60C (depicted in FIG. 4), polygon mirrors 41*a* (depicted in FIG. 3) and 41*b* (depicted in FIGS. 3 and 5), a polygon motor unit 150 (depicted in FIG. 5), insulation glasses 42 (depicted in FIGS. 3 to 5), fθ lenses 43*a* and 43*b* (depicted in FIGS. 3 and 4), first mirrors 44*a* (depicted in FIG. 3), 44*b*, 44*c*, and 44*d* (depicted in FIGS. 3 and 4), second mirrors 46*a*, 46*b*, 46*c*, and 46*d* (depicted in FIGS. 3 and 5), third mirrors 47*a*, 47*b*, 47*c*, and 47*d* (depicted in FIGS. 3 and 5), long lenses 50*a*, 50*b*, 50*c* (depicted in FIG. 3), and 50*d* (depicted in FIGS. 3 and 4), first synchronous mirrors 53*a* (depicted in FIG. 4), 53*b*, 53*c*, and 53*d* (depicted in FIG. 5), second synchronous mirrors 54*b* (depicted in FIG. 4) and 54*d* (depicted in FIG. 5), first synchronous sensors 51*a* (depicted in FIG. 5) and 51*b* (depicted in FIG. 4), holders 90*a* (depicted in FIG. 4), 90*b*, and 90*c* (depicted in FIG. 5), a container 110 (depicted in FIGS. 3 and 5), a top cover 120 (depicted in FIG. 3), a bottom cover 130 (depicted in FIG. 3), and/or dustproof glasses 48*a*, 48*b*, 48*c*, and 48*d* (depicted in FIG. 3).

As illustrated in FIG. 4, the housing 100, serving as a housing, is molded of a resin and holds the above-described elements of the optical writing unit 4. The light source units 70M, 70K, 70Y, and 70C, serving as light source units, include light sources (not shown) for emitting light beams Lm, Lk, Ly, and Lc onto the photoconductors 1M, 10K, 10Y, and 10C (depicted in FIG. 3), respectively. The cylindrical lenses 60M, 60K, 60Y, and 60C correct an optical face tangle error of the light beams Lm, Lk, Ly, and Lc emitted by the light source units 70M, 70K, 70Y, and 70C, respectively.

Each of the polygon mirrors 41*a* and 41*b* (depicted in FIG. 3), serving as a light deflector, is a rotatable, polygonal mirror and has a regular, polygonal prism shape. Each of the polygon mirrors 41*a* and 41*b* includes reflection mirrors on its side surfaces and rotates around its central axis of the regular, polygonal prism at a speed of about 32,000 rpm. The polygon motor unit 150 (depicted in FIG. 5) drives the polygon mirrors 41*a* and 41*b*. The insulation glasses 42 block heat generated by the polygon motor unit 150. The fθ lenses 43*a* and 43*b*, serving as image forming lenses, convert an equiangular motion of the light beams Lm, Lk, Ly, and Lc generated by the polygon mirrors 41*a* and 41*b* into a uniform velocity motion.

As illustrated in FIG. 3, the first mirrors 44*a*, 44*b*, 44*c*, and 44*d* deflect light beams Ly, Lc, Lm, and Lk toward the second mirrors 46*a*, 46*b*, 46*c*, and 46*d*, respectively. The second mirrors 46*a*, 46*b*, 46*c*, and 46*d* further deflect the light beams Ly, Lc, Lm, and Lk toward the third mirrors 47*a*, 47*b*, 47*c*, and 47*d*, respectively. The third mirrors 47*a*, 47*b*, 47*c*, and 47*d* further deflect the light beams Ly, Lc, Lm, and Lk toward the photoconductors 10Y, 10C, 1M, and 10K, respectively. The long lenses 50*a*, 50*b*, 50*c*, and 50*d* correct an optical face tangle error of the light beams Ly, Lc, Lm, and Lk scanned by the polygon mirrors 41*a* and 41*b*. The fθ lenses 43*a* and 43*b* and the long lenses 50*a*, 50*b*, 50*c*, and 50*d* form imaging lenses.

As illustrated in FIG. 5, the first synchronous mirrors 53*a* (depicted in FIG. 4), 53*b*, 53*c*, and 53*d* and the second synchronous mirrors 54*b* (depicted in FIG. 4) and 54*d* deflect the light beams Ly, Lc, Lm, and Lk, which are emitted toward invalid areas on the surfaces of the photoconductors 10Y, 10C, 10M, and 10K (depicted in FIG. 3) in a main scanning direction respectively, toward the first synchronous sensors 51*a* and 51*b* (depicted in FIG. 4). The first synchronous sensor 51*a* receives the light beams Lm and Lk. The first synchronous sensor 51*b* receives the light beams Ly and Lc. The holders 90*a* (depicted in FIG. 4), 90*b*, and 90*c* swingably support the long lens 50*a* (depicted in FIG. 3) for the light beam Ly, the long lens 50*b* (depicted in FIG. 3) for the light beam Lc, and the long lens 50*c* (depicted in FIG. 3) for the light beam Lm, respectively, so as to adjust the angles of the light beams Ly, Lc, and Lm emitted from emitting surfaces of the long lenses 50*a*, 50*b*, and 50*c*, respectively.

The above-described elements of the optical writing unit 4 are attached to the housing 100. For example, as illustrated in FIG. 4, the light source units 70M, 70K, 70Y, and 70C are attached to a side wall of a bottom plane of the housing 100. The cylindrical lenses 60M, 60K, 60Y, and 60C, the fθ lenses 43*a* and 43*b*, and the first mirrors 44*a* (depicted in FIG. 3), 44*b*, 44*c*, and 44*d* are attached to the bottom plane of the housing 100. The long lens 50*a* (depicted in FIG. 3) for the light beam Ly is attached to the bottom plane of the housing 100 via the holder 90*a*. The long lens 50*d* for the light beam Lk is directly attached to the bottom plane of the housing 100.

As illustrated in FIG. 5, the long lens 50*b* (depicted in FIG. 3) for the light beam Lc and the long lens 50*c* (depicted in FIG. 3) for the light beam Lm are attached to a top plane of the housing 100 via the holders 90*b* and 90*c*, respectively.

As illustrated in FIG. 3, according to example embodiments, the angles of the light beams Ly, Lc, and Lm emitted from the emitting surfaces of the long lenses 50*a*, 50*b*, and 50*c* respectively are adjusted based on the light beam Lk. Therefore, the long lens 50*d* for the light beam Lk needs not be swingably supported by a holder, resulting in the reduced number of elements of the optical writing unit 4. The second mirrors 46*a*, 46*b*, 46*c*, and 46*d* and the third mirrors 47*a*, 47*b*, 47*c*, and 47*d* are attached to the top plane of the housing 100.

As illustrated in FIG. 5, the container 110 is provided in a substantially center portion on the top plane of the housing 100. The container 110 has a concave shape and contains the polygon motor unit 150. The insulation glasses 42 are disposed on side walls of the container 110. The polygon motor unit 150 is secured to a bottom of the container 110 with screws (not shown).

As illustrated in FIG. 3, the top cover 120 is provided on the top plane of the housing 100. The bottom cover 130 is provided on the bottom plane of the housing 100. The top cover 120 includes four openings (not shown) through which the light beams Ly, Lc, Lm, and Lk deflected by the third mirrors 47*a*, 47*b*, 47*c*, and 47*d* pass toward the photoconductors 10Y, 10C, 10M, and 10K, respectively. The dustproof glasses 48*a*, 48*b*, 48*c*, and 48*d* block the openings, respectively. The top cover 120 and the bottom cover 130 reduce or prevent dust adhered to the optical elements (e.g., lenses and mirrors) of the optical writing unit 4. The top cover 120 and the bottom cover 130 include a resin and/or a sheet metal.

Referring to FIGS. 3 to 5, the following describes operations of the optical writing unit 4. As illustrated in FIG. 4, the light source units 70Y, 70C, 70M, and 70K emit light beams Ly, Lc, Lm, and Lk respectively according to light source signals converted based on image data sent from an external device (not shown), for example, an image scanner or a personal computer. The light beams Ly, Lc, Lm, and Lk pass through collimate lenses (not shown) and apertures (not shown) of the housing 100 and are formed into light beams Ly, Lc, Lm, and Lk having a reference shape. When the light beams Ly, Lc, Lm, and Lk pass through the cylindrical lenses 60Y, 60C, 60M, and 60K respectively, the cylindrical lenses 60Y, 60C, 60M, and 60K correct an optical face tangle error of the light beams Ly, Lc, Lm, and Lk respectively.

As illustrated in FIG. 5, the light beams Ly, Lc, Lm, and Lk pass through the insulation glasses 42 and irradiate the side surfaces of the polygon mirrors 41*a* (depicted in FIG. 3) and 41*b*. The polygon mirrors 41*a* and 41*b* deflect the light beams Ly, Lc, Lm, and Lk. As illustrated in FIG. 4, the deflected light beams Ly and Lc pass through the fθ lens 43*a*. The deflected light beams Lm and Lk pass through the fθ lens 43*b*.

As illustrated in FIG. 3, the light beam Lk passes through the long lens 50*d* and is deflected by the first mirror 44*d*, the second mirror 46*d*, and the third mirror 47*d*. The deflected light beam Lk passes through the dustproof glass 48*d* and irradiates the photoconductor 10K. Thus, an electrostatic latent image is formed on the photoconductor 10K.

The light beam Ly passes through the long lens 50*a* and is deflected by the first mirror 44*a*, the second mirror 46*a*, and the third mirror 47*a*. The deflected light beam Ly passes through the dustproof glass 48*a* and irradiates the photoconductor 10Y. Thus, an electrostatic latent image is formed on the photoconductor 10Y.

The light beam Lm is deflected by the first mirror 44*c*. The deflected light beam Lm passes through the long lens 50*c* and is deflected by the second mirror 46*c* and the third mirror 47*c*. The deflected light beam Lm passes through the dustproof glass 48*c* and irradiates the photoconductor 10M. Thus, an electrostatic latent image is formed on the photoconductor 10M.

The light beam Lc is deflected by the first mirror 44*b*. The deflected light beam Lc passes through the long lens 50*b* and is deflected by the second mirror 46*b* and the third mirror 47*b*. The deflected light beam Lc passes through the dustproof glass 48*b* and irradiates the photoconductor 10C. Thus, an electrostatic latent image is formed on the photoconductor 10C.

As illustrated in FIG. 5, the polygon mirrors 41*a* (depicted in FIG. 3) and 41*b* cause light beams Ly, Lc, Lm, and Lk emitted by the light source units 70Y, 70C, 70M, and 70K respectively to travel in the main scanning direction. When the light beams Ly, Lc, Lm, and Lk reach one end in the main scanning direction, the light beams Ly, Lc, Lm, and Lk move to another end in the main scanning direction. Immediately after the light beam Lk moves to another end in the main scanning direction, the light beam Lk is not deflected by the second mirror 46*d* but deflected by the first synchronous mirror 53*d* disposed beside the second mirror 46*d*. The deflected light beam Lk is deflected by the second synchronous mirror 54*d* and irradiates the first synchronous sensor 51*a*.

Immediately after the light beam Lm moves to another end in the main scanning direction, the light beam Lm is not deflected by the third mirror 47*c* but deflected by the first synchronous mirror 53*c*. The deflected light beam Lm irradiates the first synchronous sensor 51*a*.

Immediately after the light beam Lc moves to another end in the main scanning direction, the light beam Lc is not deflected by the third mirror 47*b* but deflected by the first synchronous mirror 53*b*. As illustrated in FIG. 4, the deflected light beam Lc is deflected by the second synchronous mirror 54*b* and irradiates the first synchronous sensor 51*b*.

As illustrated in FIG. 4, immediately after the light beam Ly moves to another end in the main scanning direction, the light beam Ly is not deflected by the first mirror 46*a* (depicted in FIG. 5) but deflected by the first synchronous mirror 53*a*. The deflected light beam Ly is deflected by the second synchronous mirror 54*b* and irradiates the first synchronous sensor 51*b*.

When the light beams Lk and Lm irradiate the first synchronous sensor 51*a* (depicted in FIG. 5) and the light beams Lc and Ly irradiate the first synchronous sensor 51*b*, the first synchronous sensors 51*a* and 51*b* output synchronous signals. The light source units 70Y, 70C, 70M, and 70K are driven in accordance with the synchronous signals.

Figure 6:
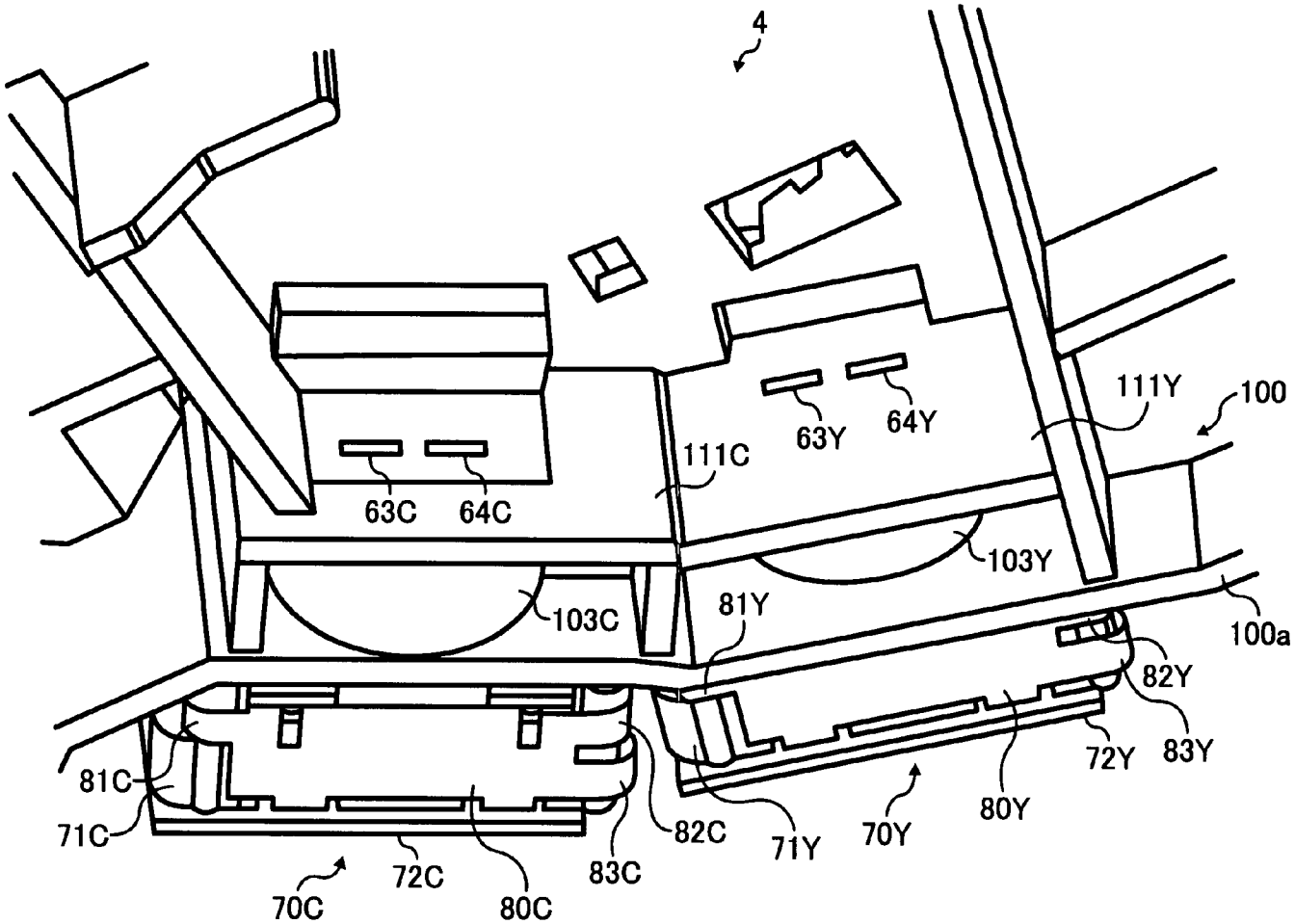
FIG. 6 is a perspective view (according to an example embodiment of the present invention) of a housing and a light source unit of the optical writing unit shown in FIG. 4.

FIG. 6 illustrates the light source units 70C and 70Y and the peripheral elements of the light source units 70C and 70Y. As illustrated in FIG. 6, the optical writing unit 4 further includes plates 80C and 80Y and/or light shields 103C and 103Y. The plate 80C includes a first engaging portion 81C, a second engaging portion 82C, and/or a third engaging portion 83C. The plate 80Y includes a first engaging portion 81Y, a second engaging portion 82Y, and/or a third engaging portion 83Y. The light source unit 70C includes a control board 72C and/or a holder 71C. The light source unit 70Y includes a control board 72Y and/or a holder 71Y. The housing 100 includes a side wall 100*a* and/or apertures 111C and 111Y. The aperture 111C includes openings 63C and 64C. The aperture 111Y includes openings 63Y and 64Y.

The light source unit 70C is attached to the side wall 100*a* via the plate 80C. The first engaging portion 81C and the second engaging portion 82C engage with the housing 100. The third engaging portion 83C engages with the holder 71C. The control board 72C is attached to a rear side plane of the holder 71C. The aperture 111C, serving as an aperture, opposes the light source unit 70C. The aperture 111C is integrally molded with the housing 100, resulting in the reduced number of assembly processes. The aperture 111C needs not be separately manufactured from the housing 100, resulting in the reduced number of elements and reduced manufacturing costs of the optical writing unit 4. The two openings 63C and 64C, serving as openings, are provided on the aperture 111C. Thus, the light source unit 70C emits two light beams at a time.

The polygon mirrors 41*a* and 41*b* (depicted in FIG. 3) can provide a multi-beam scanning method. For example, the polygon mirrors 41*a* and 41*b* scan two or more light beams at a time. The light shield 103C, serving as a light shield, has a cylindrical shape and is provided between the side wall 100*a* and the aperture 111C. The light shield 103C shields a flare light beam diffused from the light source unit 70C. The light shield 103C is integrally molded with the housing 100, resulting in the reduced number of assembly processes. The light shield 103C needs not be separately manufactured from the housing 100, resulting in the reduced number of elements and reduced manufacturing costs of the optical writing unit 4.

The light source unit 70Y is also attached to the side wall 100*a* via the plate 80Y. The first engaging portion 81Y and the second engaging portion 82Y engage with the housing 100. The third engaging portion 83Y engages with the holder 71Y. The control board 72Y is attached to a rear side plane of the holder 71Y. The aperture 111Y opposes the light source unit 70Y and is integrally molded with the housing 100. The two openings 63Y and 64Y are provided on the aperture 111Y.

The light shield 103Y has a cylindrical shape and is provided between the side wall 100*a* and the aperture 111Y. The light shield 103Y shields a flare light beam diffused from the light source unit 70Y. The light shield 103Y is integrally molded with the housing 100. The light shields 103C and 103Y shield flare light beams diffused from the light source units 70C and 70Y, respectively, preventing the flare light beams from irradiating optical elements of the optical writing unit 4.

The flare light beams do not irradiate the first synchronous sensors 51*a* (depicted in FIG. 5) and 51*b* (depicted in FIG. 4). Therefore, the first synchronous sensors 51*a* and 51*b* do not output synchronous signals at different times. For example, the first synchronous sensors 51*a* and 51*b* synchronously output synchronous signals at a proper time, preventing a faulty image from being formed. The flare light beams do not irradiate the photoconductors 10C and 10Y (depicted in FIG. 3), preventing a faulty image having a jitter from being formed. The light source units 70M and 70K and the peripheral elements of the light source units 70M and 70K have the structure common to the light source units 70C and 70Y and the peripheral elements of the light source units 70C and 70Y.

Figure 7:
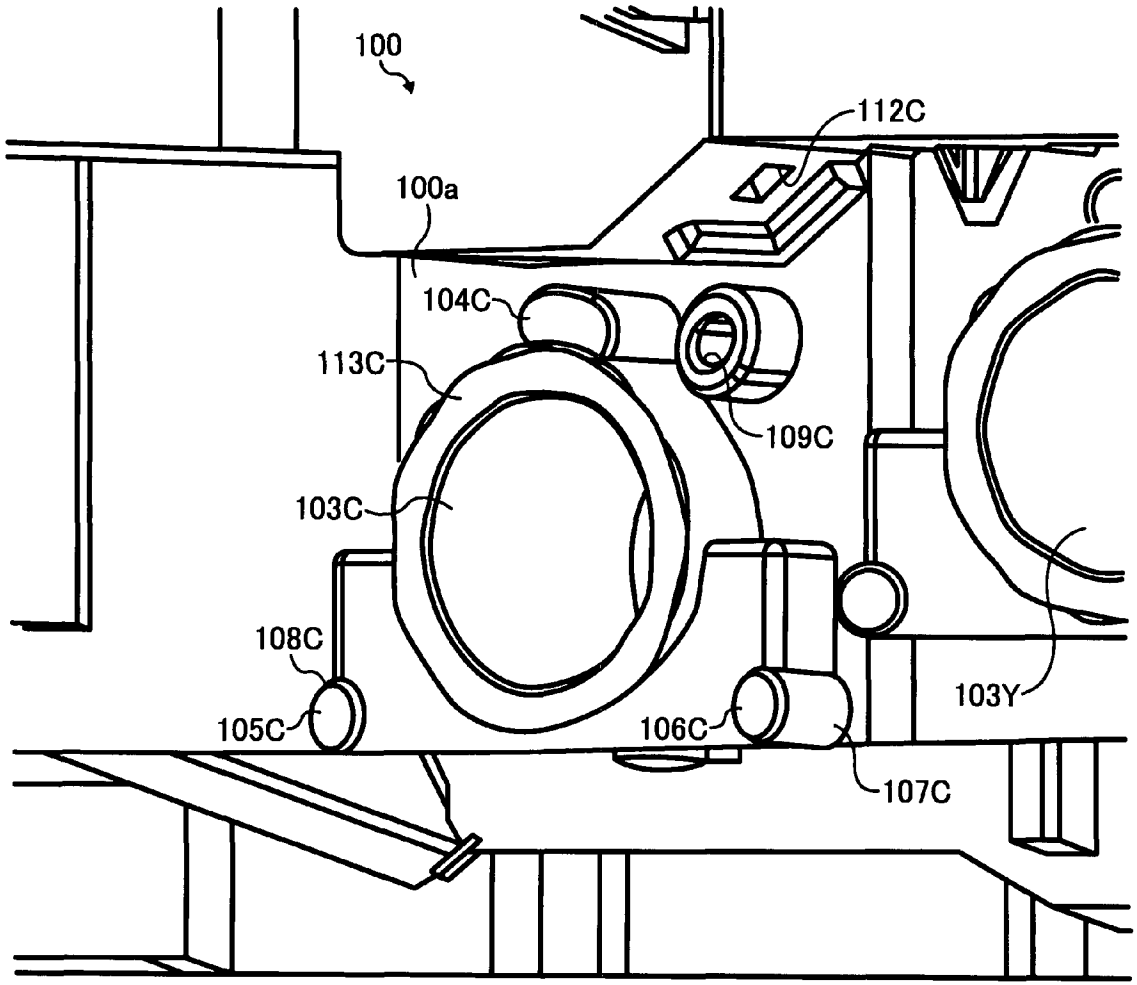
FIG. 7 is a perspective view (according to an example embodiment of the present invention) of the housing shown in FIG. 6.

Referring to FIGS. 7 to 13, the following describes the light source unit 70C and the peripheral elements of the light source unit 70C. However, the light source units 70Y, 70M, and 70K and the peripheral elements of the light source units 70Y, 70M, and 70K have the structure common to the light source unit 70C and the peripheral elements of the light source unit 70C. FIG. 7 illustrates the side wall 100*a* and the peripheral elements of the side wall 100*a* near the light source unit 70C (depicted in FIG. 6). As illustrated in FIG. 7, the housing 100 further includes a mounting opening 113C, positioning top surfaces 104C, 105C, and 106C, positioning side surfaces 107C and 108C, and/or holes 109C and 112C.

The mounting opening 113C, serving as a mounting opening, is formed on the side wall 100*a*. A part of the light source unit 70C is rotatably inserted in the mounting opening 113C. The positioning top surfaces 104C, 105C, and 106C are provided near the mounting opening 113C on the side wall 100*a* and position the light source unit 70C. The positioning side surfaces 107C and 108C are formed in a direction perpendicular to the positioning top surfaces 106C and 105C, respectively. The hole 109C is provided on the side wall 100*a* and includes a groove on its inner circumferential surface.

When the light source unit 70C emits a single light beam, the light source unit 70C is secured to the hole 109C with a screw. The hole 112C is disposed on an upper portion of the side wall 100*a*. When the light source unit 70C emits two light beams, the light source unit 70C is rotatably secured to the hole 112C with an adjustment screw. Thus, the housing 100 according to example embodiments can support the light source unit 70C using either a single beam scanning method or a multi-beam scanning method, resulting in reduced manufacturing costs of the optical writing unit 4. The housing 100 further includes the peripheral elements of the side wall 100*a*, which have the structure common to the elements illustrated in FIG. 7, near the light source units 70Y, 70M, and 70K.

The following describes the light source unit 70C using the multi-beam scanning method for emitting two light beams. In the multi-beam scanning method, the light source unit 70C emits light beams on different positions in a vertical direction. The different positions in the vertical direction correspond to positions in a sub-scanning direction on the photoconductor 10C (depicted in FIG. 3). When the light source unit 70C emits light beams on the different positions in the vertical direction, the light beams irradiate different positions in the sub-scanning direction on the photoconductor 10C. In the multi-beam scanning method, two light beams are scanned onto the photoconductors 10C at a time, resulting in an increased image forming speed.

Figure 8:
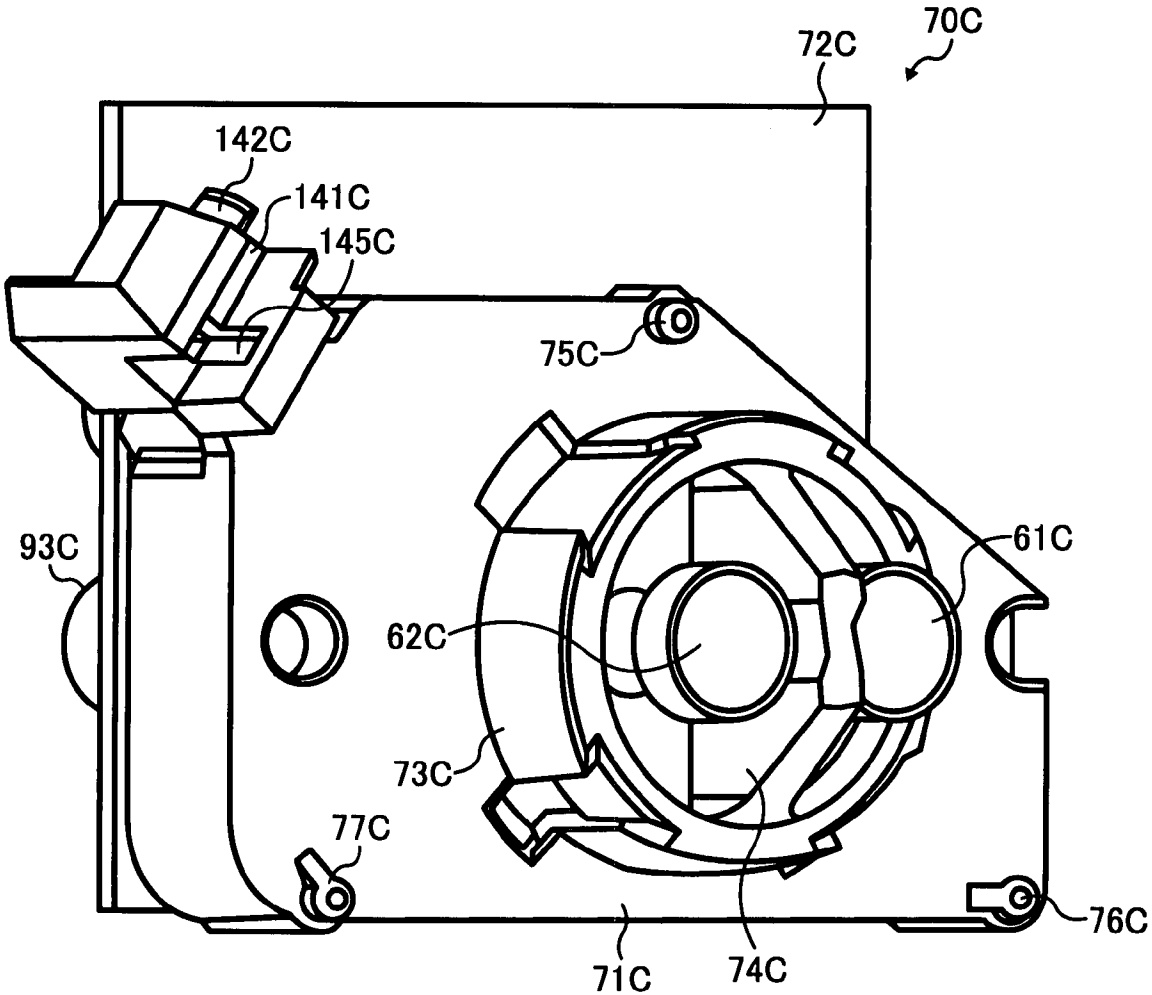
FIG. 8 is a perspective view (according to an example embodiment of the present invention) of the light source unit shown in FIG. 6.
Figure 9:
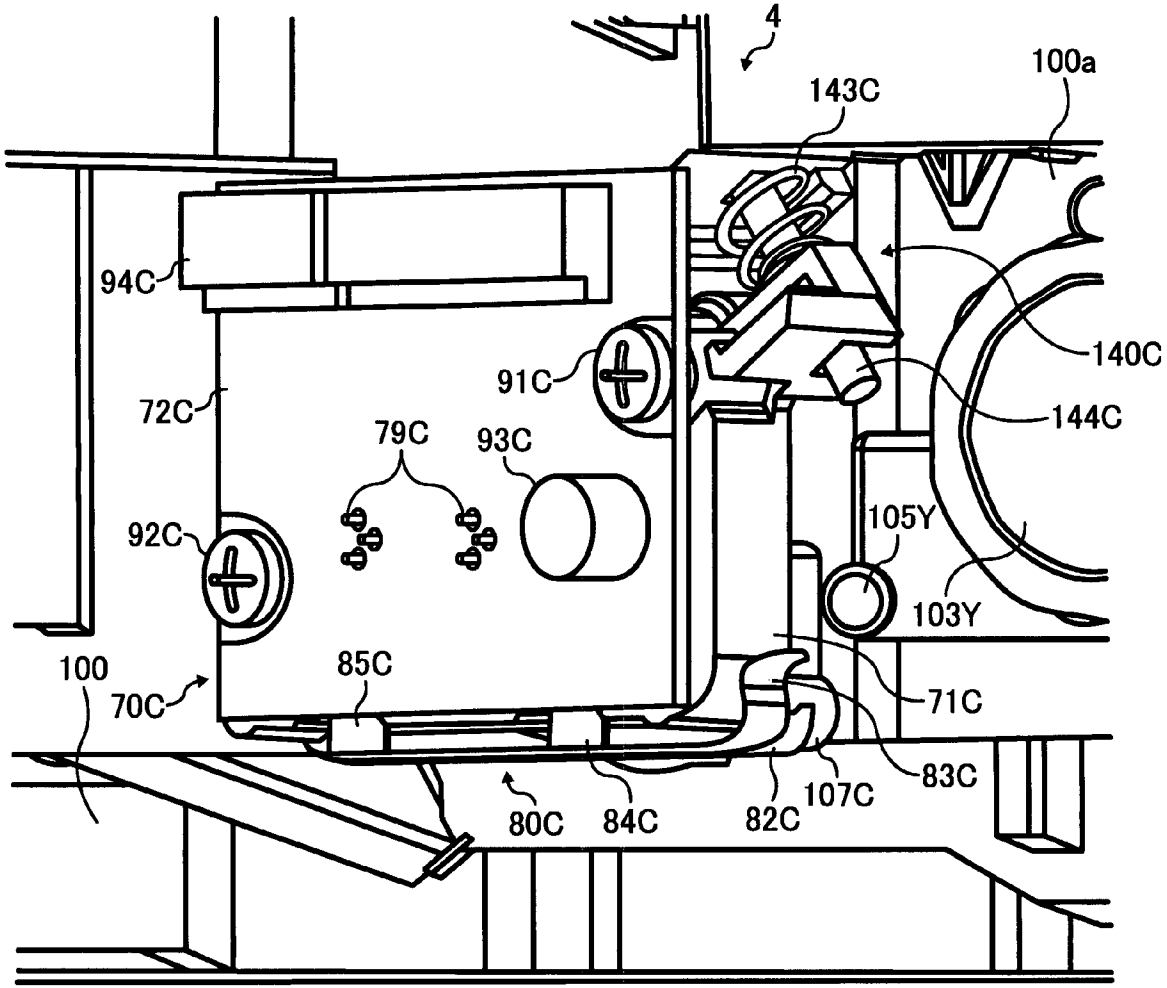
FIG. 9 is a perspective view (according to an example embodiment of the present invention) of the light source unit shown in FIG. 8 attached to the housing shown in FIG. 7.

FIG. 8 illustrates the light source unit 70C using the multi-beam scanning method. FIG. 9 illustrates the light source unit 70C using the multi-beam scanning method, which is attached to the side wall 100*a*. The light source units 70Y, 70M, and 70K have the structure common to the light source unit 70C illustrated in FIGS. 8 and 9. As illustrated in FIG. 8, the light source unit 70C further includes an electronic component 93C, a positioner 73C, a wall 74C, positioning protrusions 75C, 76C, and 77C, collimate lenses 61C and 62C, a groove 141C, a spring support 142C, and/or a pin groove 145C. As illustrated in FIG. 9, the light source unit 70C further includes laser diodes 79C, a connector 94C, and/or screws 91C and 92C. The optical writing unit 4 further includes a pitch adjuster 140C. The pitch adjuster 140C includes an adjusting screw 144C and/or an adjusting spring 143C. The plate 80C includes convex portions 84C and 85C.

As illustrated in FIG. 9, the two laser diodes 79C serving as light sources, the electronic component 93C (depicted in FIG. 8), and the connector 94C are attached to the control board 72C. The control board 72C is attached to the rear side plane of the holder 71C with the screws 91C and 92C.

As illustrated in FIG. 8, the positioner 73C has a cylindrical shape and is disposed on a front side plane of the holder 71C. The positioner 73C is inserted into the mounting opening 113C (depicted in FIG. 7) formed on the side wall 100*a* (depicted in FIG. 7). The wall 74C is disposed on an inner circumferential surface of the positioner 73C and cuts off a light beam emitted by the laser diodes 79C (depicted in FIG. 9). The positioning protrusions 75C, 76C, and 77C are disposed at three spots on the front side plane of the holder 71C. The positioning protrusions 75C, 76C, and 77C contact the positioning top surfaces 104C, 105C, and 106C (depicted in FIG. 7), respectively.

The collimate lenses 61C and 62C are attached to a lens holder (not shown). The groove 141C and the spring support 142C are disposed on a side wall of the holder 71C. The adjusting screw 144C (depicted in FIG. 9) is inserted into the groove 141C. The spring support 142C supports the adjusting spring 143C (depicted in FIG. 9). The pin groove 145C engages with a pin (not shown) provided on the adjusting screw 144C.

Figure 10:
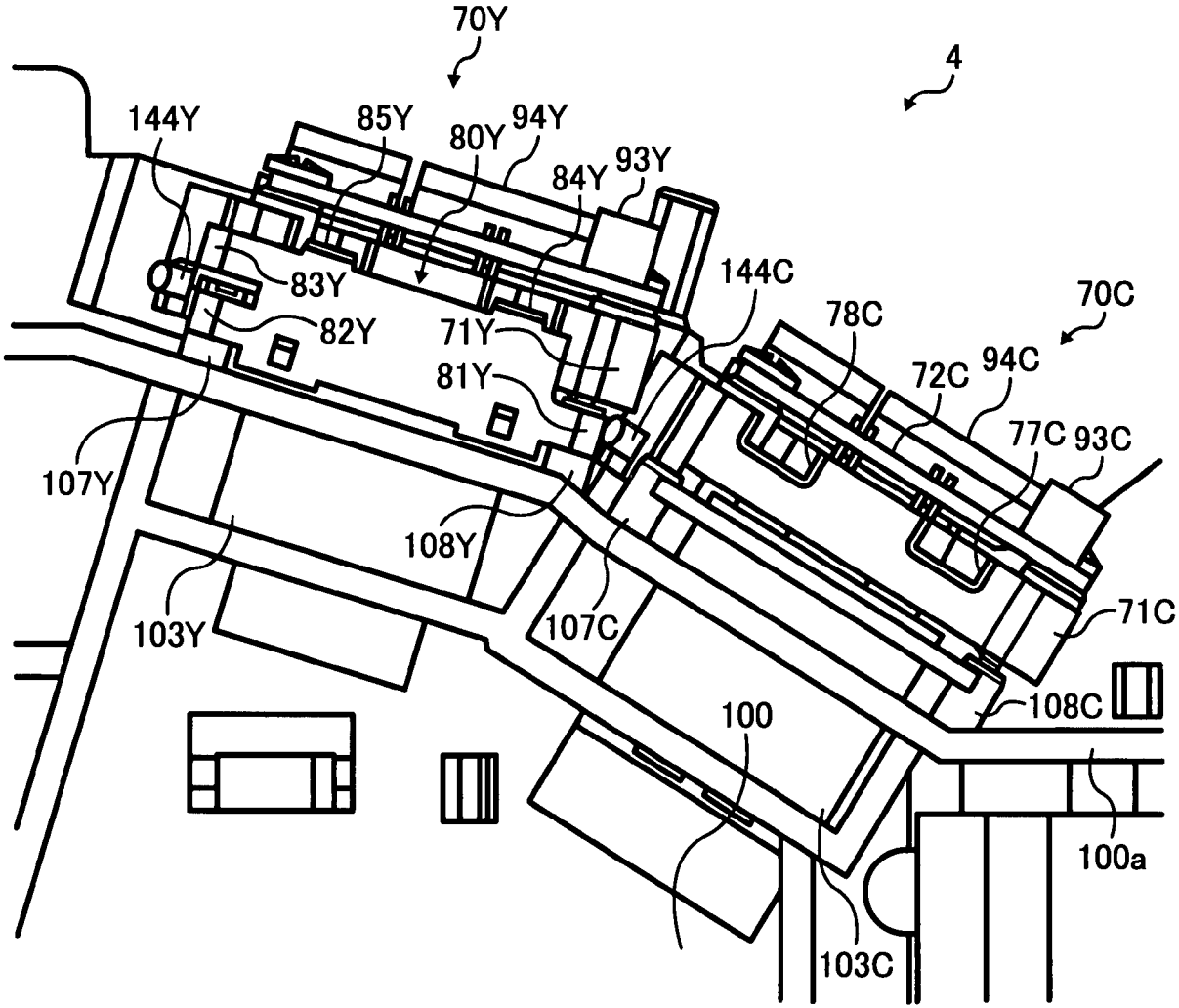
FIG. 10 is a perspective view (according to an example embodiment of the present invention) of the light source unit shown in FIG. 9 before being attached to the housing shown in FIG. 7.
Figure 11:
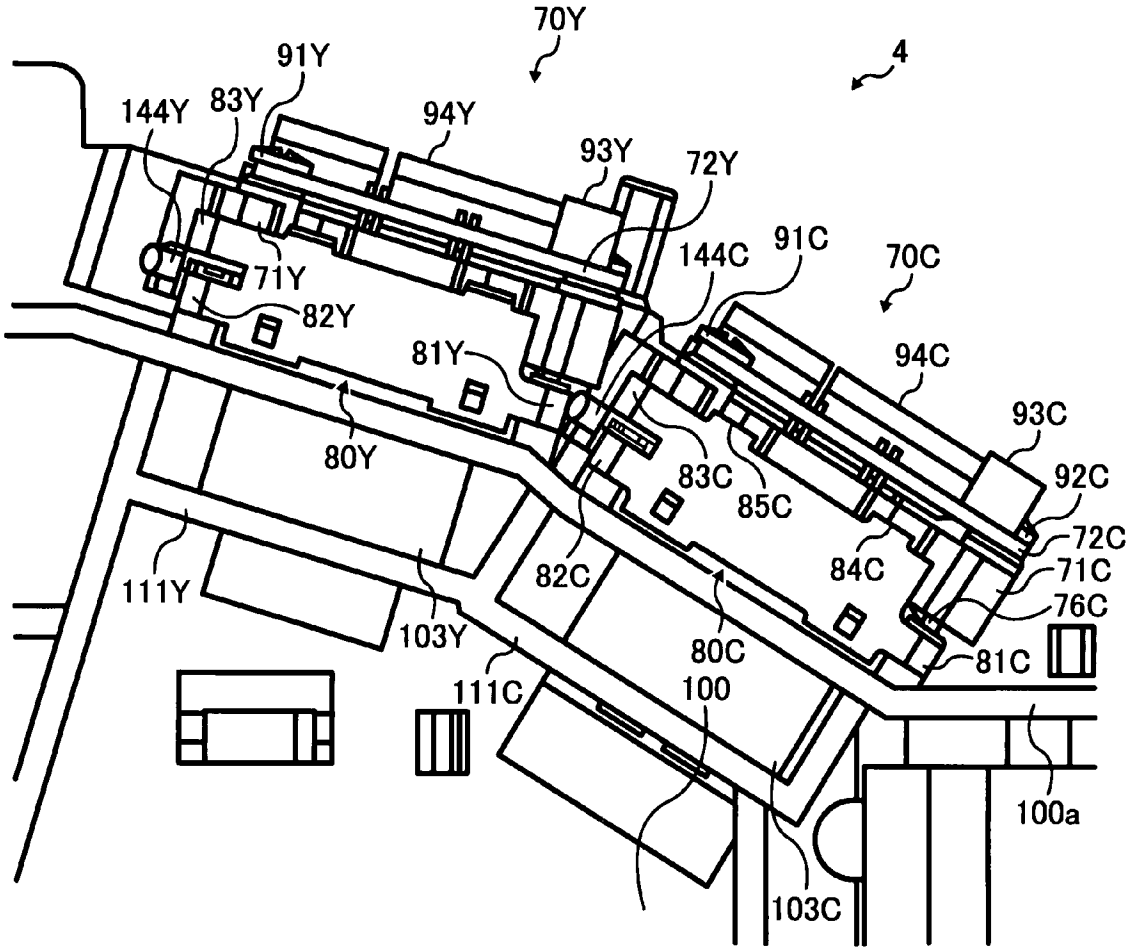
FIG. 11 is a perspective view (according to an example embodiment of the present invention) of the light source unit shown in FIG. 9 after being attached to the housing shown in FIG. 7.

As illustrated in FIG. 9, the light source unit 70C is attached to the housing 100 via the plate 80C. FIG. 10 illustrates the light source unit 70C before being attached to the housing 100 via the plate 80C (depicted in FIG. 9). FIG. 11 illustrates the light source unit 70C after being attached to the housing 100 via the plate 80C. As illustrated in FIG. 10, the holder 71C includes concave portions 77C and 78C.

As illustrated in FIG. 10, the concave portions 77C and 78C are formed at two positions on a lower portion of the holder 71. The convex portions 84C and 85C (depicted in FIG. 9) contact bottoms of the concave portions 77C and 78C, respectively. Thus, the light source unit 70C is attached to the side wall 100*a* without looseness.

As illustrated in FIG. 11, the first engaging portion 81C engages with the positioning side surface 108C (depicted in FIG. 7). The second engaging portion 82C engages with the positioning side surface 107C (depicted in FIG. 7). The third engaging portion 83C engages with a side surface of the holder 71C. Each of the first engaging portion 81C, the second engaging portion 82C, and the third engaging portion 83C is warped downward to form a plate spring. The first engaging portion 81C engaging with the positioning side surface 108C, the second engaging portion 82C engaging with the positioning side surface 107C, and the third engaging portion 83C engaging with the holder 71C cause the light source unit 70C to be attached to the side wall 100*a*.

As illustrated in FIG. 9, a space is formed between a top surface of the plate 80C and a bottom surface of the holder 71C. The light source unit 70C is swingable around the positioner 73C (depicted in FIG. 8) having the cylindrical shape in the space.

In the light source unit 70C using the multi-beam scanning method, a distance between two light beams in the vertical direction appears as a distance (e.g., a pitch) between two light beams in the sub-scanning direction formed on the photoconductor 10C (depicted in FIG. 3). As illustrated in FIG. 9, the pitch adjuster 140C adjusts the pitch between the two light beams in the sub-scanning direction formed on the photoconductor 10C. The adjusting screw 144C includes a pin (not shown) engaging with the pin groove 145C (depicted in FIG. 8) provided on the holder 71C. The adjusting spring 143C applies a force to the holder 71C. The adjusting screw 144C is inserted into the hole 112C (depicted in FIG. 7) including a groove. Thus, the adjusting screw 144C engages with the hole 112C.

When the adjusting screw 144C is turned, the rotating adjusting screw 144C moves in a direction to which the adjusting spring 143C applies a force. The holder 71C rotates around the positioner 73C (depicted in FIG. 8) via the pin of the adjusting screw 144C. Thus, the pitch between the two light beams is adjusted.

As illustrated in FIG. 9, according to example embodiments, the aperture 111C (depicted in FIG. 6) is integrally molded with the housing 100. For example, the aperture 111C is separately provided from the light source unit 70C. When the aperture 111C is integrally molded with the light source unit 70C, the aperture 111C rotates with the light source unit 70C rotated by the pitch adjuster 144. When the aperture 111C rotates, an incident angle of a light beam emitted onto the photoconductor 10C (depicted in FIG. 3) may become large.

Deviation of light beams in the sub-scanning direction may become large. As a result, image magnification may vary in the main scanning direction, degrading image quality. According to example embodiments, the aperture 111C is not integrally molded with the light source unit 70C. Therefore, the aperture 111C does not rotate with the rotating light source unit 70C. An incident angle of a light beam emitted onto the photoconductor 10C may not become large. Thus, deviation of light beams in the sub-scanning direction may not become large.

Figure 12A:
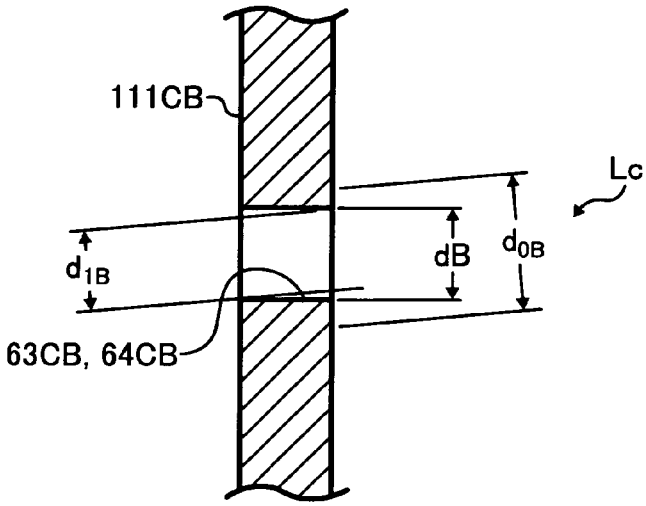
FIG. 12A is a sectional view (according to an example embodiment of the present invention) of an aperture of the housing shown in FIG. 6 without an opening having a taper shape.
Figure 12B:
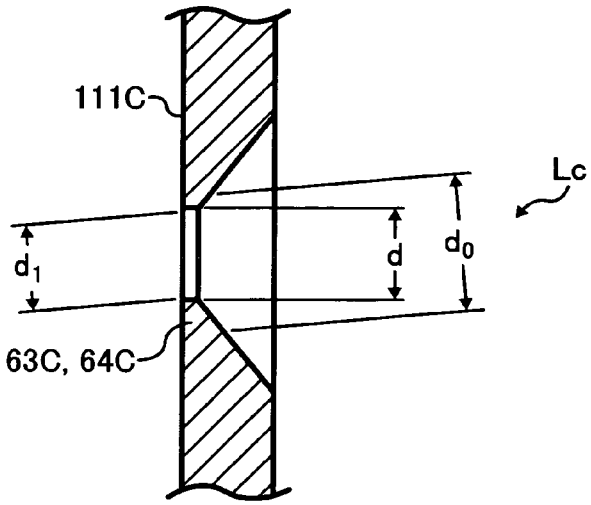
FIG. 12B is a sectional view (according to an example embodiment of the present invention) of an aperture of the housing shown in FIG. 6 with an opening having a taper shape.

FIG. 12A illustrates an aperture 111CB including openings 63CB and 64CB not having a taper shape. FIG. 12B illustrates the aperture 111C including the openings 63C and 64C having a taper shape. As illustrated in FIG. 12B, according to example embodiments, the openings 63C and 64C have a taper shape. For example, the openings 63C and 64C in cross section are widened toward the mounting opening 113 (depicted in FIG. 7).

As illustrated in FIGS. 12A and 12B, diameters doB and do illustrate diameters of light beams Lc collimated by the collimate lens 61C or 62C, respectively. Diameters dB and d illustrate desired effective diameters of light beams Lc entering the opening 63CB or 64CB and the opening 63C or 64C at a right angle with respect to the apertures 111CB and 111C, respectively. Diameters d1B and d1 illustrate effective diameters of light beams Lc entering the opening 63CB or 64CB and the opening 63C or 64C obliquely with respect to the apertures 111CB and 111C, respectively.

As illustrated in FIG. 12A, when the openings 63CB and 64CB do not have a taper shape, the effective diameter d1B of a light beam Lc passing through the opening 63CB or 64CB substantially deviates from the desired effective diameter dB. As illustrated in FIG. 12B, when the openings 63C and 64C have a taper shape, the aperture 111C has a small thickness near the openings 63C and 64C. Therefore, the effective diameter d1 of a light beam Lc passing through the opening 63C or 64C does not substantially deviate from the desired effective diameter d.

When the whole aperture 111C has a small thickness, the strength of the aperture 111C may decrease and thereby the openings 63C and 64C may not be properly formed. Especially, when the aperture 111C is formed by injection molding with a resin, only the aperture 111C may have a small thickness and the uneven thickness may decrease an accuracy in manufacturing the openings 63C and 64C.

Figure 13:
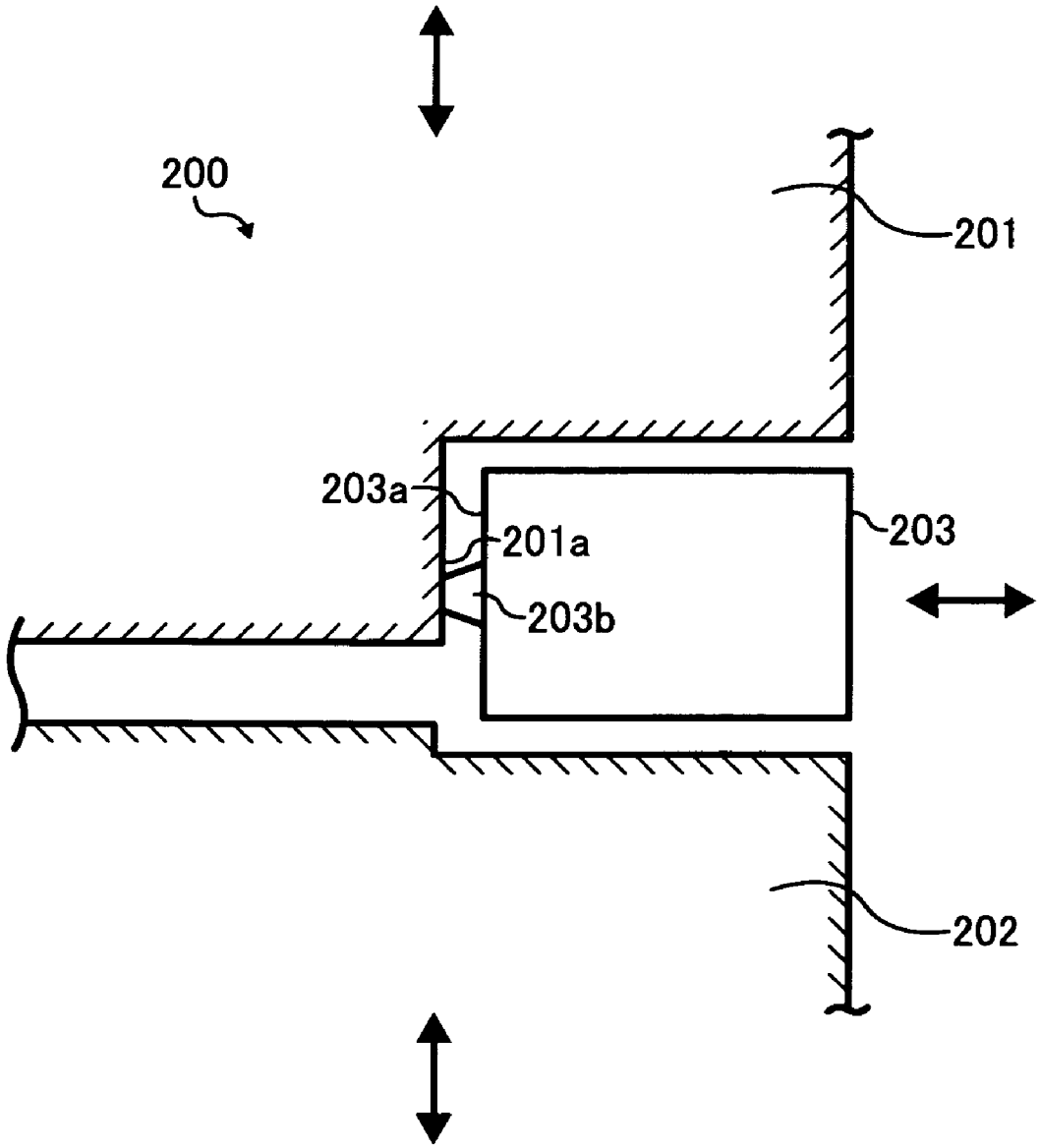
FIG. 13 is a sectional view (according to an example embodiment of the present invention) of a mold for molding an aperture and a light shield of the housing shown in FIG. 6.

Referring to FIG. 13, the following describes a housing molding method for molding the housing 100 (depicted in FIG. 6). According to example embodiments, the housing 100 is molded by injection molding with a resin. The light shield 103C (depicted in FIG. 6) and the aperture 111C (depicted in FIG. 6) are molded with a resin.

FIG. 13 illustrates a mold 200 for molding the housing 100. The mold 200 includes an upper mold 201, a lower mold 202, and/or an insert 203. The insert 203 includes a foremost surface 203*a* and/or an aperture opening forming protrusion 203*b*. The upper mold 201 includes an aperture forming portion 201*a*.

The upper mold 201, serving as a housing mold, is opened upward. The lower mold 202, serving as a housing mold, is opened downward. The upper mold 201 and the lower mold 202 are arranged to form a cavity for forming walls (e.g., side walls and/or inner walls) of the housing 100. When the upper mold 201 and the lower mold 202 are combined, the upper mold 201 and the lower mold 202 form an insertion space having a cup-like shape into which the insert 203 is inserted.

The insert 203, serving as an insert, is movable in a direction perpendicular to the direction in which the upper mold 201 and the lower mold 202 are opened. The aperture opening forming protrusion 203*b*, serving as an aperture opening forming protrusion, is provided on the foremost surface 203*a*, serving as a foremost head, of the insert 203 in the direction in which the insert 203 moves into the insertion space.

When the upper mold 201 and the lower mold 202 are combined, the insert 203 is inserted into the insertion space until the aperture opening forming protrusion 203*b* touches the aperture forming portion 201*a*, serving as an aperture mold, of the upper mold 201. Thus, a cavity is formed between the outer circumferential surface of the insert 203 and the upper mold 201 and between the outer circumferential surface of the insert 203 and the lower mold 202. A cavity is also formed between the foremost surface 203*a* and the aperture forming portion 201*a*.

When the insert 203 is inserted into the insertion space, the cavities are filled with a melted resin to form the housing 100. For example, the cavity formed between the outer circumferential surface of the insert 203 and the upper mold 201 and between the outer circumferential surface of the insert 203 and the lower mold 202 is filled with a melted resin to form the light shield 103C. The cavity formed between the foremost surface 203*a* and the aperture forming portion 201*a* is filled with a melted resin to form the aperture 111C. When the melted resin is solidified, the insert 203 is removed from the insertion space. The upper mold 201 and the lower mold 203 are opened to remove the housing 100. Thus, the light shield 103C and the aperture 111C are integrally molded with the housing 100.

As illustrated in FIG. 6, in an optical writing device (e.g., the optical writing unit 4 depicted in FIG. 1) according to example embodiments, a light shield (e.g., the light shield 103C) shields a light beam diffused from a light source (e.g., the laser diodes 79C depicted in FIG. 9) of a light source unit (e.g., the light source unit 70C) and a light beam reflected by an optical lens (e.g., collimate lenses 61C and 62C depicted in FIG. 8) provided between the laser diodes 79C and an aperture (e.g., the aperture 111C).

Thus, the diffused light beam and the reflected light beam do not reach the surface of an electrostatic latent image carrier (e.g., the photoconductor 10C depicted in FIG. 3) and the first synchronous sensors 51*a* (depicted in FIG. 5) and 51*b* (depicted in FIG. 4). The aperture 111C and the light shield 103C are integrally molded with a housing (e.g., the housing 100), resulting in the reduced number of assembly processes and the reduced number of elements.

The laser diodes 79C are provided in the light source unit 70C. The light source unit 70C is attached to the housing 100 via a mounting opening (e.g., the mounting opening 113C depicted in FIG. 7) formed on a wall (e.g., the side wall 100*a*) of the housing 100. Thus, the light source unit 70C can be easily attached to and detached from the optical writing unit 4. The light shield 103C can prevent dust from entering an inner portion of the housing 100, in which optical elements are arranged, through the mounting opening 113C while the light source unit 70C is attached to or detached from the optical writing unit 4.

The light source unit 70C includes at least one laser diode 79C. Thus, the light source unit 70C can employ the multi-beam scanning method in which light beams generated by two or more laser diodes 79C are emitted onto different scanning lines on the surface of the photoconductor 10C at a time, resulting in an increased image forming speed.

The light source unit 70C is rotatably attached to the mounting opening 113C. The distance (e.g., a pitch) between two light beams in the sub-scanning direction formed on the photoconductor 10C can be adjusted by rotating the light source unit 70C.

As illustrated in FIG. 6, the cut-through direction of the mounting opening 113C (depicted in FIG. 7) is substantially common to the cut-through direction (e.g., an extending direction) of openings (e.g., the openings 63C and 64C) formed on the aperture 111C.

As illustrated in FIG. 13, the housing 100 (depicted in FIG. 6) is molded with molds (e.g., the upper mold 201 and the lower mold 202) used for injection molding with a resin. When the upper mold 201 and the lower mold 202 are combined, an insert (e.g., the insert 203) is inserted in the direction perpendicular to the direction in which the upper mold 201 and the lower mold 202 are opened. An aperture opening forming protrusion (e.g., the aperture opening forming protrusion 203*b*) is disposed on a portion (e.g., the foremost surface 203*a*) of the insert 203, which forms a light-shielding wall on the aperture 111C (depicted in FIG. 6). Injection molding is performed while the aperture opening forming protrusion 203*b* contacts a portion (e.g., the aperture forming portion 201*a*) of the upper mold 201. Thus, the insert 203 can form the mounting opening 113C (depicted in FIG. 7) and the openings 63C and 64C at a time.

As illustrated in FIG. 4, a tandem type image forming apparatus (e.g., the image forming apparatus 1 depicted in FIG. 1) having a plurality of photoconductors (e.g., the photoconductors 10Y, 10C, 10M, and 10K depicted in FIG. 1) may include a plurality of light source units (e.g., the light source units 70Y, 70C, 70M, and 70K). The light source units 70Y, 70C, 70M, and 70K include the light shields 103Y, 103C, 103M, and 103K (depicted in FIG. 6), respectively. The light shields 103Y, 103C, 103M, and 103K shield flare light beams diffused from the light source units 70Y, 70C, 70M, and 70K, respectively. Thus, the flare light beams may not reach the surfaces of the photoconductors 10Y, 10C, 10M, and 10K and may not be received by the first synchronous sensors 51*a* (depicted in FIG. 5) and 51*b*.

As illustrated in FIG. 5, light deflectors (e.g., the polygon mirrors 41*a* (depicted in FIG. 3) and 41*b*) deflect light beams generated by the plurality of the light source units 70Y, 70C, 70M, and 70K, resulting in the reduced number of the light deflectors and reduced manufacturing costs of the light deflectors.

As illustrated in FIG. 12B, the openings 63C and 64C have a taper shape. For example, the openings 63C and 64C in cross section are widened toward the mounting opening 113C (depicted in FIG. 7). Even when the laser diodes 79C (depicted in FIG. 9) are positioned obliquely with respect to the openings 63C and 64C, the effective diameter dl of a light beam shaped by the aperture 111C may not substantially deviate from the desired effective diameter d.

As illustrated in FIG. 1, according to example embodiments, the image forming apparatus 1 includes the optical writing unit 4. Thus, the image forming apparatus 1 can form a high quality image.

As illustrated in FIG. 13, in the housing molding method according to example embodiments, the insert 203 is inserted into a space, which is formed by the combined upper mold 201 and the lower mold 202, in the direction perpendicular to the direction in which the upper mold 201 and the lower mold 202 are opened. Thus, a cavity for forming the aperture 111C (depicted in FIG. 6) and a cavity for forming the light shield 103C (depicted in FIG. 6) are formed. The cavities are filled with a melted resin to form the aperture 111C and the light shield 103C.

For example, the insert 203 is inserted in the direction perpendicular to the direction in which the upper mold 201 and the lower mold 202 are opened, so as to integrally mold the aperture 111C and the light shield 103C with the housing 100 (depicted in FIG. 6). When the housing 100 is molded, the aperture 111C and the light shield 103C can be molded at a time. Thus, the above-described housing molding method can manufacture the aperture 111C and the light shield 103C with the number of manufacturing processes smaller than the number of processes included in a method in which the aperture 111C and the light shield 103C are formed in an extra cutting process after the housing 100 is molded.

As illustrated in FIG. 6, according to example embodiments, the light shield 103C shields an optical path in which a light beam generated by the laser diodes 79C (depicted in FIG. 9) of the light source unit 70C travels to the aperture 111C. The light shield 103C shields a light beam diffused from the laser diodes 79C and a light beam deflected by an optical lens (e.g., the collimate lenses 61C and 62C depicted in FIG. 8) provided between the laser diodes 79C and the aperture 111C. The diffused light beam and the deflected light beam may not reach the surface of the photoconductor 10C (depicted in FIG. 3) and may not be received by the first synchronous sensors 51*a* (depicted in FIG. 5) and 51*b* (depicted in FIG. 4).

As a result, the photoconductor 10C may not form a faulty image and the first synchronous sensors 51*a* and 51*b* may not erroneously detect the light beam. The aperture 111C and the light shield 103C are integrally molded with the housing 100, resulting in the reduced number of assembly processes and the reduced number of elements of the optical writing unit 4.

As illustrated in FIG. 4, according to example embodiments, the optical writing unit 4 includes four light source units (e.g., the light source units 70Y, 70C, 70M, and 70K). Each of the light source units 70Y, 70C, 70M, and 70K includes two light sources (e.g., the laser diodes 79C depicted in FIG. 9). However, the optical writing unit 4 may include one or more light source units and each of the light source units may include one or more light sources. Each of the light source units 70Y, 70C, 70M, and 70K may also include one or more light sources.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. An image forming apparatus, comprising:

an electrostatic latent image carrier to carry an electrostatic latent image; and an optical writing device, including a housing including a side wall;

at least one light source to generate a plurality of light beams at a time, the at least one light source including, a plurality of laser diodes to emit the plurality of light beams;

a plurality of collimate lenses corresponding to the plurality of laser diodes, a cylindrical positioner, a holder provided with the cylindrical positioner to rotate around the cylindrical positioner to adjust a pitch between the plurality of light beams in a sub-scanning direction, and an inner wall provided inside the housing at an interior position of the side wall of the housing to cut off the plurality of light beams emitted by the plurality of laser diodes, at least one aperture including a plurality of openings formed on the inner wall to adjust the corresponding plurality of light beams generated by the at least one light source into a reference shape, at least one cylindrical light shield provided between the side wall and the inner wall continuously without gap or opening to shield an optical path formed between the at least one light source and the at least one aperture by the plurality of light beams generated by the at least one light source such that the at least one cylindrical light shield does not leak the light beams from the at least one light source to the inner wall, a light deflector to deflect the plurality of light beams generated by the at least one light source to scan at a time in a main scanning direction, an image forming lens to focus the plurality of light beams deflected by the light deflector to scan on the surface of the electrostatic latent image carrier to form an electrostatic latent image on the surface of the electrostatic latent image carrier, the housing to contain the at least one light source, the light deflector, and the image forming lens, and a cylindrical mounting opening formed on the side wall of the housing, wherein the cylindrical positioner of the at least one light source is detachably inserted into the cylindrical mounting opening formed on the side wall of the housing, wherein the side wall of the housing is integrally molded with the inner wall, the at least one light shield, and the cylindrical mounting opening by injection molding with a resin to form the cylindrical mounting opening and the at least one cylindrical light shield into a cylinder, and wherein the at least one aperture and the at least one cylindrical light shield are formed by a cylindrical insert and a protruding portion formed on a foremost surface of the cylindrical insert, the protruding portion being attached to the inner wall of the housing during a molding process.

2. The image forming apparatus according to claim 1, wherein the optical writing device further includes at least one light source unit including the at least one light source.

3. The image forming apparatus according to claim 2, wherein the image forming lens focuses the plurality of light beams generated by the at least one light source to scan different portions on the surface of the electrostatic latent image carrier at a time.

4. The image forming apparatus according to claim 3, wherein the mounting opening rotatably holds the at least one light source unit.

5. The image forming apparatus according to claim 2, wherein the opening of the at least one aperture extends in a direction substantially common to a cut-through direction of the mounting opening.

6. The image forming apparatus according to claim 2, wherein the at least one aperture and the at least one light shield are provided for each of the at least one light source units.

7. The image forming apparatus according to claim 6, wherein the light deflector deflects the plurality of light beams generated by each of the at least one light source units.

8. The image forming apparatus according to claim 5, wherein the opening is tapered such that a cross-section area of the opening is relatively widened toward the mounting opening.

9. The image forming apparatus according to claim 2, wherein each of a plurality of the apertures and each of a plurality of the light shields are respectively provided for each of a plurality of the light source units, and wherein the light deflector deflects the plurality of light beams generated by the plurality of the light source units.

10. An optical writing device for forming an electrostatic latent image on an electrostatic latent image carrier, comprising:

a housing including a side wall;

at least one light source to generate a plurality of light beams at a time;

the at least one light source including, a plurality of laser diodes to emit the plurality of light beams;

a plurality of collimate lenses corresponding to the plurality of laser diodes, a cylindrical positioner, a holder provided with the cylindrical positioner to rotate around the cylindrical positioner to adjust a pitch between the plurality of light beams in a sub-scanning direction, and an inner wall provided inside the housing at an interior position of the side wall of the housing to cut off the plurality of light beams emitted by the plurality of laser diodes, at least one aperture including a plurality of openings formed on the inner wall to adjust the corresponding plurality of light beams generated by the at least one light source into a reference shape;

at least one cylindrical light shield provided between the side wall and the inner wall continuously without gap or opening to shield an optical path formed between the at least one light source and the at least one aperture by the plurality of light beams generated by the at least one light source such that the at least one cylindrical light shield does not leak the light beams from the at least one light source to the inner wall;

a light deflector to deflect the plurality of light beams generated by the at least one light source to scan at a time in a main scanning direction;

an image forming lens to focus the plurality of light beams deflected by the light deflector to scan on the surface of the electrostatic latent image carrier to form an electrostatic latent image on the surface of the electrostatic latent image carrier;

the housing to contain the at least one light source, the light deflector, and the image forming lens, and a cylindrical mounting opening formed on the side wall of the housing, wherein the cylindrical positioner of the at least one light source is detachably inserted into the cylindrical mounting opening formed on the side wall of the housing, wherein the side wall of the housing is integrally molded with the inner wall, the at least one light shield, and the cylindrical mounting opening by injection molding with a resin to form the cylindrical mounting opening and the at least one cylindrical light shield into a cylinder, and wherein the at least one aperture and the at least one cylindrical light shield are formed by a cylindrical insert and a protruding portion formed on a foremost surface of the cylindrical insert, the protruding portion being attached to the inner wall of the housing during a molding process.

11. The optical writing device according to claim 10, further comprising:

at least one light source unit including the at least one light source.

12. The optical writing device according to claim 11, wherein the image forming lens focuses the plurality of light beams generated by the at least one light source to scan different portions on the surface of the electrostatic latent image carrier at a time.

13. The optical writing device according to claim 12, wherein the mounting opening rotatably holds the at least one light source unit.

14. The optical writing device according to claim 11, wherein the opening of the at least one aperture extends in a direction substantially common to a cut-through direction of the mounting opening.

15. The optical writing device according to claim 11, wherein the at least one aperture and the at least one light shield are provided for each of the at least one light source units.

16. The optical writing device according to claim 15, wherein the light deflector deflects the plurality of light beams generated by the at least one light source unit.

17. The optical writing device according to claim 14, wherein the opening is tapered such that a cross-section area of the opening is relatively widened toward the mounting opening.

* * * * *